US012064798B2

(12) United States Patent
Shimoda et al.

(10) Patent No.: US 12,064,798 B2
(45) Date of Patent: Aug. 20, 2024

(54) METHOD FOR PRODUCING SEAMLESS METAL TUBE

(71) Applicant: NIPPON STEEL CORPORATION, Tokyo (JP)

(72) Inventors: Kazuhiro Shimoda, Tokyo (JP); Kouji Yamane, Tokyo (JP); Koichi Kuroda, Tokyo (JP); Yuji Inoue, Tokyo (JP); Shusuke Shimooka, Tokyo (JP); Kazuyuki Murakami, Tokyo (JP); Kota Shindo, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 201 days.

(21) Appl. No.: 17/758,049

(22) PCT Filed: Sep. 28, 2020

(86) PCT No.: PCT/JP2020/036582
§ 371 (c)(1),
(2) Date: Jun. 27, 2022

(87) PCT Pub. No.: WO2021/145027
PCT Pub. Date: Jul. 22, 2021

(65) Prior Publication Data

US 2023/0054014 A1 Feb. 23, 2023

(30) Foreign Application Priority Data

Jan. 14, 2020 (JP) ..... 2020-003451

(51) Int. Cl.
*B21B 19/04* (2006.01)
*B21B 27/02* (2006.01)

(52) U.S. Cl.
CPC ..... *B21B 19/04* (2013.01); *B21B 27/02* (2013.01)

(58) Field of Classification Search
CPC ..... B21B 19/04; B21B 19/06; B21B 19/02; B21B 19/10
See application file for complete search history.

(56) References Cited

U.S. PATENT DOCUMENTS 4,510,787 A * 4/1985 Hayashi ..... B21B 19/06 72/368
2009/0064748 A1* 3/2009 Yamakawa ..... B21B 19/04 72/97

(Continued)

FOREIGN PATENT DOCUMENTS

JP 59080716 A 5/1984
JP 64031505 A 2/1989

(Continued)

*Primary Examiner* — Bobby Yeonjin Kim
(74) *Attorney, Agent, or Firm* — GREER BURNS & CRAIN, LTD.

(57) ABSTRACT

A method disclosed herewith is a method for producing a first seamless metal tube with a first wall thickness and a second seamless metal tube with a second wall thickness by using a three-roll-type inclined rolling mill, and the method includes a first inclination rolling step (#5), a setting changing step (#10), and a second inclination rolling step (#15). At the first inclination rolling step, a first workpiece is rolled by the inclined rolling mill. At the setting changing step, a setup condition of the inclined rolling mill is changed in a manner (a) or (b) as described below. At the second inclined rolling step, a second workpiece is rolled by the inclined rolling mill under the changed condition. (a) When the second wall thickness is smaller than the first wall thickness, the cross angle of each of the inclined rolls is made greater than the cross angle set for the first inclination rolling step. (b) When the second wall thickness is larger than the first wall thickness, the cross angle of each of the inclined rolls is made smaller than the cross angle set for the first inclination rolling step.

6 Claims, 14 Drawing Sheets

(56) References Cited

U.S. PATENT DOCUMENTS

2012/0174642 A1* 7/2012 Yamane ..... B21B 27/024
72/224
2013/0255342 A1* 10/2013 Saitou ..... B21B 19/04
72/208

FOREIGN PATENT DOCUMENTS

JP 02263506 A 10/1990
JP 05228514 A 9/1993

* cited by examiner

METHOD FOR PRODUCING SEAMLESS METAL TUBE

TECHNICAL FIELD

The present invention relates to a method for producing a seamless metal tube by Mannesmann process.

BACKGROUND ART

Generally, a method for producing a seamless metal tube by Mannesmann process includes the following steps. A round billet is heated to a predetermined temperature. The round billet is piercing-rolled to be formed into a hollow shell (a seamless metal pipe). The hollow shell is further elongating-rolled and diameter-adjusting-rolled. At the piercing-rolling step, a piercing-rolling mill (for example, a piercer) is used. At the elongating-rolling step, an elongating-rolling mill (for example, a mandrel mill or an elongator) is used. The piercing-rolling mill is an inclined rolling mill. In some cases, an inclined rolling mill is used as the elongating-rolling mill.

Such inclined rolling mills are disclosed, for example, in Japanese Patent Application Publication H05-228514 (Patent Literature 1), Japanese Patent Application Publication H02-263506 (Patent Literature 2), Japanese Patent Application Publication S64-31505 (Patent Literature 3) and Japanese Patent Application Publication S59-80716 (Patent Literature 4).

Such an inclined rolling mill includes a plug and two inclined rolls as a rolling tool. In some cases, an inclined rolling mill includes three inclined rolls. An inclined rolling mill with two inclined rolls is referred to as two-roll-type inclined rolling mill. An inclined rolling mill with three inclined rolls is referred to as three-roll-type inclined rolling mill. The inclined rolls are arranged equiangularly around a pass line. The central axis of each of the inclined rolls is inclined from the pass line. In other words, each of the inclined rolls has a feed angle. In some cases, each of the inclined rolls additionally has a cross angle. The plug is located on the pass line between the inclined rolls.

When the inclined rolling mill is used as the piercing-rolling mill, the inclination rolling (piercing rolling) is carried out in the following manner. A round solid billet is used as a workpiece for the piercing rolling. A heated workpiece is placed on the pass line. The workpiece is conveyed to between the rolling inclined rolls by a pusher and comes in engagement with the inclined rolls. Then, the workpiece moves forward on the pass line while rolling around its own axis and is piercing-rolled by the inclined rolls and the plug. In this way, a hollow shell (a seamless metal tube) with a predetermined wall thickness and a predetermined outer diameter can be obtained.

When the inclined rolling mill is used as the elongating-rolling mill, the process of the inclination rolling (elongating rolling) is the same as the process of piercing rolling except that a hollow shell is used as a workpiece for the elongating rolling.

A piercer (a piercing-rolling mill) that carries out the first step (piercing-rolling step) of a seamless metal tube production method by Mannesmann process was put to practical use by Mannesmann brothers in 1885. The piercer at that time was a basic two-roll type. Since the piercer was put to practical use, the piercer has been continuously subjected to various improvements, and still now, the piercer is used in factories all around the world. Other piercing machines different from this piercer have been put to practical use, but almost all the piercing machines other than the piercer used in Mannesmann process have dropped out of use, except for Erhardt piercing process and Eugene extrusion process. This is because the piercer is excellent in productivity and dimensional accuracy of products. Therefore, it is not an exaggeration to say that only the piercer (piercing-rolling mill) is the only successful piercing machine in the industry.

However, the current two-roll type piercer has some problems to be solved. There are two main problems as described below.

One of the problems is an occurrence of inner flaws due to Mannesmann fracture. Mannesmann fracture means a phenomenon that the central portion of a workpiece embrittles and fractures. In a two-roll-type piercer, a guiding tool (for example, a plate shoe or a disk roll) is located between the inclined rolls around the pass line. The guiding tool works to restrict bulging of the workpiece. During the piercing rolling (inclination rolling), the central portion of the rolling workpiece receives a compression stress, which acts in the direction in which the inclined rolls face each other, and a tensile stress, which acts in the direction in which the guide members face each other, at the same time. These stresses act repeatedly every quarter turn of the workpiece. This repetitious loading of these stresses causes Mannesmann fracture. When the Mannesmann fracture is severe, the produced hollow shell has flaws in the inner surface. These flaws are inner flaws.

For many years, Mannesmann fracture has been used beneficially, and a plug has been pressed into the fracturing central portion of the workpiece to pierce the workpiece. This way of piercing is easy. However, this way of piercing causes inner flaws.

In recent years, some measures to suppress Mannesmann fracture are taken. An example of the measures is using conical inclined rolls. However, there are no measures to completely prevent Mannesmann fracture. Accordingly, the problem of inner flaws is still unsolved. Especially when the workpiece is a casted billet or a material with low workability such as stainless steel or the like, Mannesmann fracture is promoted, and inner flaws are more likely to occur.

Mannesmann fracture becomes severe as the number of repetitions of loading of the above-described stresses, that is, as the number of rotations of the workpiece is increasing. Therefore, increasing the entrance-side lateral surface angle of each of the inclined rolls to decrease the distance between the point where the workpiece comes into contact with the inclined rolls and the point where the workpiece comes into contact with the tip of the plug is one measure to suppress Mannesmann fracture. However, in a two-roll-type piercer, each of the inclined rolls typically has an entrance-side lateral surface angle of about 3 degrees. The reason is as follows. During piercing rolling by using a two-roll-type piercer, the workpiece is likely to shift in a direction perpendicular to the direction in which the inclined rolls face each other, which often leads to an engagement failure, and therefore, it is difficult to adopt a large entrance-side lateral surface angle.

The second problem is an occurrence of outer flaws due to damage of a disk roll. A disk roll is a guiding tool provided in a two-roll-type piercer. In other times, a fixed plate shoe was used as a guiding tool. During piercing rolling (inclination rolling), the plate shoe slide against the workpiece. When the sliding motion was heavy, the produced hollow shell had flaws on the outer surface. These flaws are called outer flaws.

In recent years, the plate shoe is replaced with a rotary disk roll. The use of a disk roll reduces the frequency of occurrence of outer flaws.

However, the rotation direction of the disk roll is not necessarily the same as the rotation direction of the workpiece. Therefore, it is impossible to prevent galling between the surface of the disk roll and the outer surface of the workpiece. Additionally, it is impossible to prevent deformation of the surface of the disk roll. Therefore, it is necessary to take care of the surface of the disk roll or exchange the disk roll for a new one on a regular basis.

CITATION LIST

Patent Literature

Patent Literature 1: Japanese Patent Application Publication No. H05-228514

Patent Literature 2: Japanese Patent Application Publication No. H02-263506

Patent Literature 3: Japanese Patent Application Publication No. S64-31505

Patent Literature 4: Japanese Patent Application Publication No. S59-80716

SUMMARY OF INVENTION

Technical Problem

A three-roll-type inclined rolling mill solves the two problems described above. In the three-roll-type inclined rolling mill, unlike in a two-roll-type inclined rolling mill, only a compression stress acts on the central portion of the workpiece during inclination rolling, and therefore, Mannesmann fracture does not occur. Accordingly, inner flaws are not caused. In the three-roll-type inclined rolling mill, no guiding tool is used. Accordingly, outer flaws are not caused. Thus, in order to solve the quality problems inherent in inclination rolling performed by a two-roll-type inclined mill, it is significantly effective to use a three-roll-type inclined rolling mill for inclination rolling.

However, such a three-roll-type inclined rolling mill is not practically used to produce a seamless metal tube. For example, it is difficult to produce a seamless metal tube with a small wall thickness by piercing rolling using a three-roll-type inclined rolling mill. This is because any guiding tools are not used in the three-roll-type inclined rolling mill. Installing a guiding tool in the three-roll-type inclined rolling mill has been considered, but it has not been put into practice. It is because installing a guiding tool in the three-roll-type inclined rolling mill is hard in terms of structure. At present, the three-roll-type inclined rolling mill is used only as an elongating-rolling mill, such as an assel mill or the like, specialized to produce a seamless metal tube with a large wall thickness from a hollow shell.

The three-roll-type inclined rolling mill is desired to be usable in every case of producing a seamless metal tube. Therefore, it is important that any seamless metal tube, whether it has a small wall thickness or a large wall thickness, can be produced with no quality problem by inclination rolling using a three-roll-type inclined rolling mill.

An object of the present invention is to provide a seamless metal tube production method that permits practical use of a three-roll-type inclined rolling mill.

Solution to Problem

A seamless metal tube production method according to an embodiment of the present invention is to produce a first seamless metal tube with a first wall thickness and a second seamless metal tube with a second wall thickness, which is different from the first wall thickness, by using an inclined rolling mill. The inclined rolling mill includes: a plug located on a pass line; and three inclined rolls arranged equiangularly around the pass line, each of which has an entrance-side lateral surface and an exit-side lateral surface. The distance between the pass line and the entrance-side lateral surface decreases gradually with increasing distance from an entrance of the inclined rolls and decreasing distance from an exit of the inclined rolls along the pass line, and the distance between the pass line and the exit-side lateral surface increases gradually with increasing distance from the entrance of the inclined rolls and decreasing distance from the exit of the inclined rolls along the pass line.

The production method includes a first inclination rolling step, a setting changing step, and a second inclination rolling step. At the inclination rolling step, a first heated workpiece is rolled by the inclined rolling mill. At the setting changing step, a setup condition of the inclined rolling mill is changed in a manner (a) or (b) as described below. At the second inclination rolling step, a second heated workpiece is rolled by the inclined rolling mill under the changed setup condition.

(a) when the second wall thickness is smaller than the first wall thickness, a cross angle of each of the inclined rolls is made greater than a cross angle of each of the inclined rolls set for the first inclination rolling step.

(b) when the second wall thickness is larger than the first wall thickness, the cross angle of each of the inclined rolls is made smaller than the cross angle of each of the inclined rolls set for the first inclination rolling step.

Effect of Invention

The production method according to the embodiment of the present invention makes it possible to produce a thin-walled seamless metal tube and a thick-walled seamless metal tube without causing any quality problems by using a three-roll-type inclined rolling mill. Thus, the production method puts the three-roll-type inclined rolling mill to practical use.

DESCRIPTION OF EMBODIMENTS

In order to attain the object above, the inventors conducted studies, and as a result, the inventors made the following findings.

[Fundamental Structure of Three-Roll-Type Inclined Rolling Mill]

Figure 1:
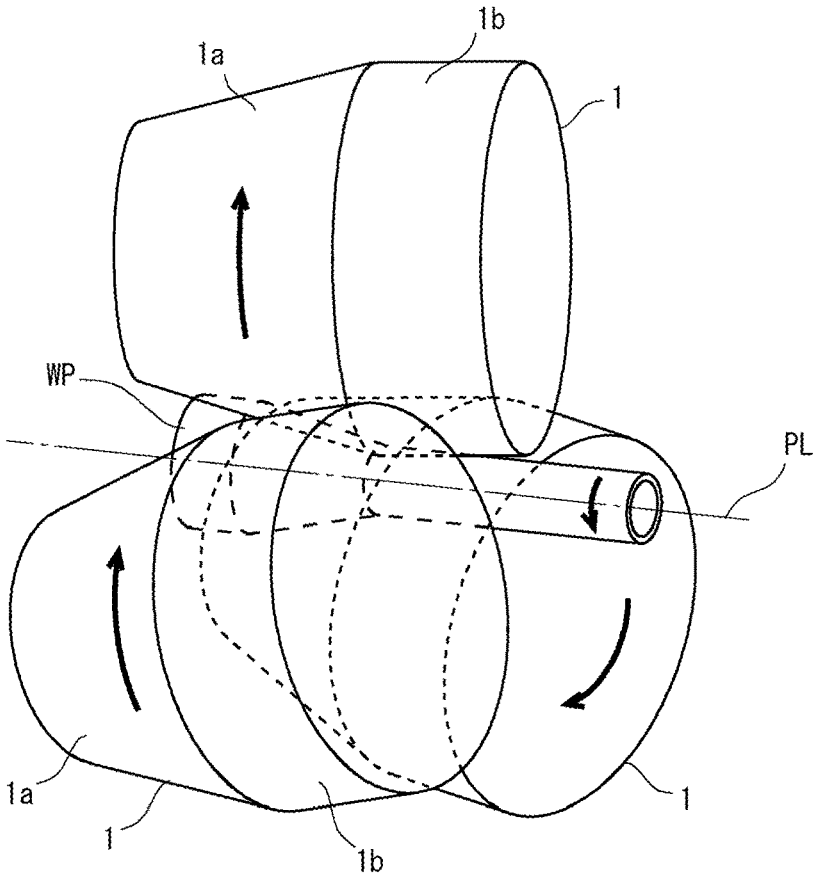
FIG. 1 is a diagrammatic perspective view of a three-roll-type inclined rolling mill.
Figure 2:
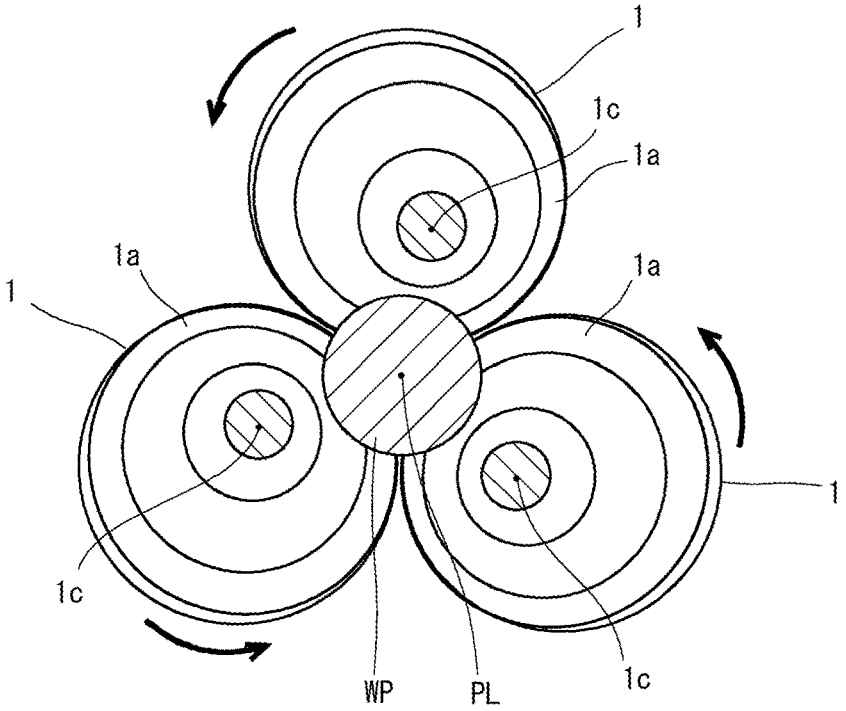
FIG. 2 is a front view of the three-roll-type inclined rolling mill.
Figure 3:
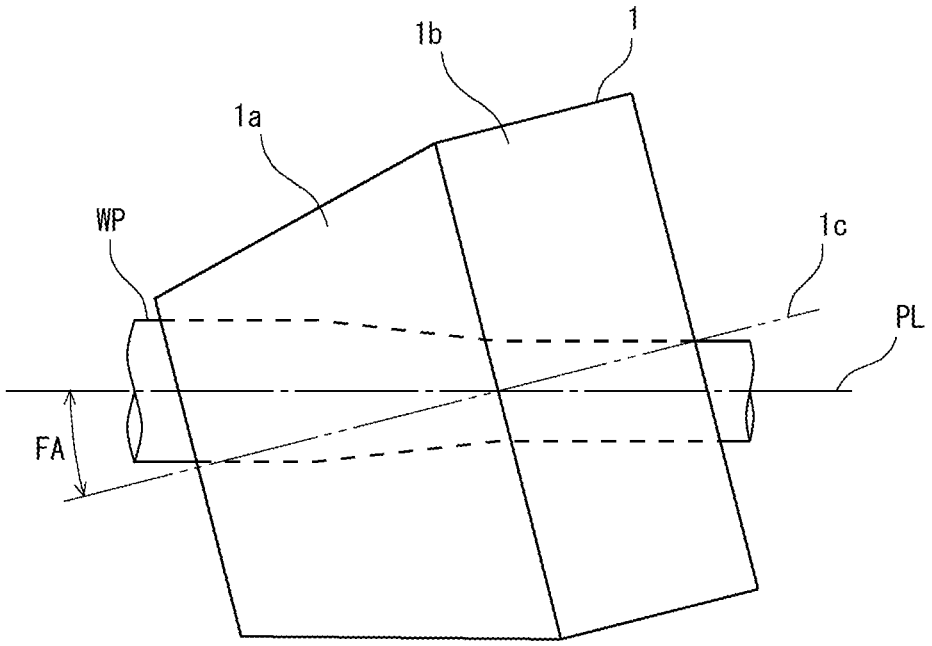
FIG. 3 is a top view of the three-roll-type inclined rolling mill.
Figure 4:
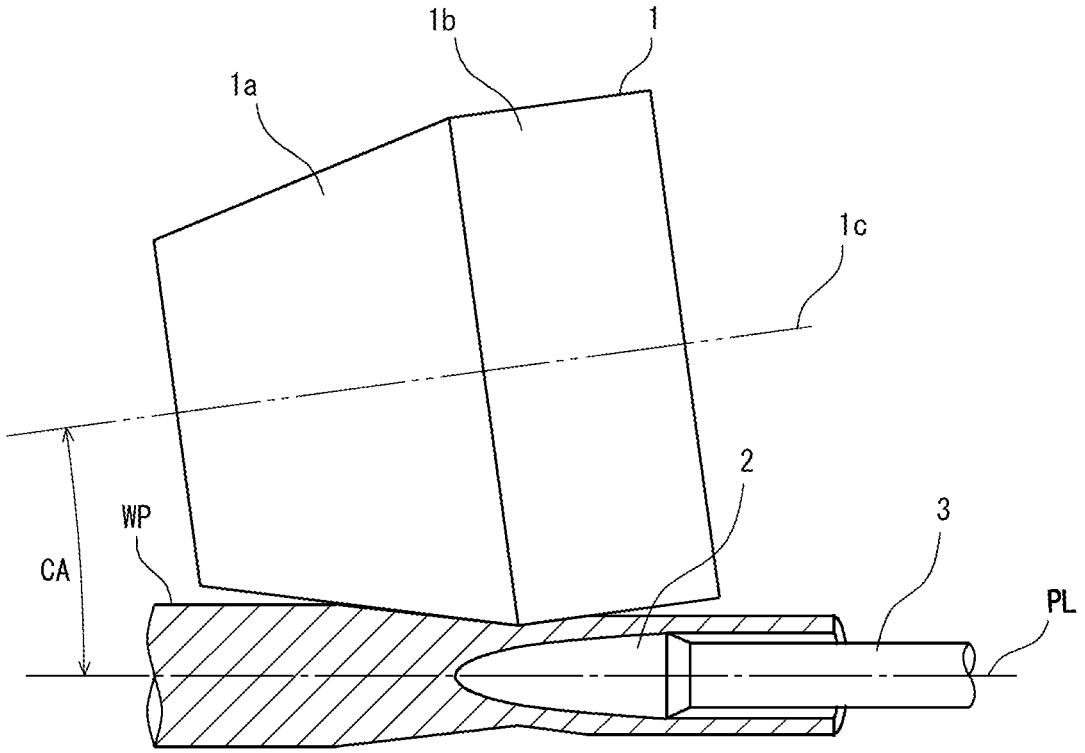
FIG. 4 is a side view of the three-roll-type inclined rolling mill.

FIGS. 1 to 4 are diagrams showing the structure of a three-roll-type inclined rolling mill. Among these figures, FIG. 1 is a perspective view of the inclined rolling mill when viewed from the exit side of the inclined rolling mill. FIG. 2 is a front view of the inclined rolling mill when viewed along a pass line PL from the entrance side of the rolling mill. FIG. 3 is a top view of the inclined rolling mill. FIG. 4 is a side view of the inclined rolling mill. FIG. 1 omits an illustration of a plug 2. FIGS. 3 and 4 show only one inclined roll located above the pass line PL as the topmost roll 1 and omit illustrations of the other lower two inclined rolls 1. In FIG. 4, the workpiece WP is shown as a section in a plane including the pass line PL. FIGS. 1 to 4 show a case in which the workpiece WP is a round solid billet. In other words, the inclined rolling mill shown in FIGS. 1 to 4 is a piercing-rolling mill used for piercing rolling. In the present specification, the three-roll-type inclined rolling mill will be sometimes referred to simply as inclined rolling mill.

With reference to FIGS. 1 to 4, the inclined rolling mill includes a plug 2 and three inclined rolls 1 as a rolling tool. The three inclined rolls 1 are located equiangularly around the pass line PL. Specifically, the three inclined rolls 1 are positioned at an angle of 120 degrees to one another. One of the three inclined rolls 1 is located immediately above (along the vertical direction) the pass line PL. As long as the three inclined rolls 1 are located equiangularly around the pass line PL, there are no other limitations to the positions of the three inclined rolls 1. For example, one of the inclined rolls 1 may be immediately below (along the vertical direction) the pass line PL. The lateral surface of each of the inclined rolls 1 is divided into an entrance-side lateral surface 1*a* and an exit-side lateral surface 1*b*, which are positioned side by side along the pass line PL.

Each of the inclined rolls 1 has a central axis 1*c* inclined from the pass line PL. In other words, each of the inclined rolls 1 has a feed angle FA (see FIG. 3). Each of the inclined rolls 1 has a cross angle CA (see FIG. 4). The feed angle FA and the cross angle CA are adjustable. Additionally, each of the inclined rolls 1 has an opening relative to the pass line PL. This roll opening is adjustable.

The feed angle FA is the deflection angle of the central axis 1*c* of the inclined roll 1 from the pass line PL in the circumferential direction around the pass line PL. The cross angle CA is the deflection angle of the central axis 1*c* of the inclined roll 1 from the pass line PL in the radial direction from the pass line PL.

The distance between the pass line PL and the entrance-side lateral surface 1*a* gradually decreases with increasing distance from the entrance of the inclined roll and decreasing distance from the exit of the inclined roll along the pass line PL. On the other hand, the distance between the pass line PL and the exit-side lateral surface 1*b* gradually increases with increasing distance from the entrance and decreasing distance from the exit along the pass line PL. The entrance-side lateral surface 1*a* is, for example, a taper surface with a constant gradient. The exit-side lateral surface 1*b* is, for example, a taper surface with a constant gradient.

The plug 2 is located on the pass line PL among the inclined rolls 1. The plug 2 is held by a mandrel bar extending along the pass line PL.

Inclination rolling (piercing rolling) using such an inclined rolling mill is performed as follows. The workpiece WP, which is a round billet, is heated. The heated workpiece WP is placed on the pass line PL. The workpiece WP is pushed by a pusher to come in among and come in engagement with the rotating inclined rolls 1. Then, the workpiece WP moves forward on the pass line PL while rotating around its own axis, and the workpiece PL is pierced and rolled by the inclined rolls 1 and the plug 2. In this way, a hollow shell (a seamless metal tube) with a predetermined wall thickness and a predetermined outer diameter is produced.

When the inclined rolling mill is used as an elongating-rolling mill, the process of inclination rolling (elongating rolling) is the same as the process of piercing rolling except that the workpiece to be subjected to the elongating rolling is a hollow shell. Specifically, the workpiece moves forward while rotating around its own axis, and the workpiece is elongated and rolled by the inclined rolls 1 and the plug 2.

[Study for Practical Use of Three-Roll-Type Inclined Rolling Mill]

The inventors first focused on piercing rolling, which is one of the above-described kinds of inclination rolling (piercing rolling and elongating rolling) using a three-roll-type inclined rolling mill. It was because the processing conditions for piercing rolling are much more severe than the processing conditions for elongating rolling. The inventors attempted the production of a seamless metal tube with a small wall thickness, which had been considered as a weak point of piercing rolling using a three-roll-type inclined rolling mill (three-roll-type piercer).

In the present specification, the production of a seamless metal tube with a small wall thickness will be sometimes referred to as thin-walled tube making.

If thin-walled tube making is carried out by piercing rolling using a three-roll-type inclined rolling mill, the material of the workpiece will partly thrust into between adjacent inclined rolls, and the workpiece will stop rotating. This is the reason why thin-walled tube making is difficult.

As a first countermeasure, the inventors attempted to decrease the amount of wall-thickness processing conducted by the plug. The inventors thought that it would be possible to decrease the amount of material thrusting into between adjacent inclined rolls by decreasing the amount of wall-thickness processing. As a means to do this, the inventors adopted decreasing the roll opening. By decreasing the roll opening, the outer diameter of the workpiece becomes smaller before the workpiece reaches the tip of the plug, and thereafter, the outer diameter of the workpiece becomes greater. Thereby, the amount of wall-thickness processing conducted by the plug can be decreased. For example, when two hollow shells with the same outer diameter and the same wall thickness are produced respectively from two workpieces with different cross-sectional areas (different diameters), the workpiece with a smaller cross-sectional area (smaller diameter) needs to be processed less in total.

However, the inventors found that if the roll opening is too small relative to the outer diameter of the workpiece, the outer diameter of the hollow shell produced by piercing rolling becomes uneven with respect to the length direction. In this case, the workpiece needs to be processed to a great degree, which causes an imbalance between the volume of material flow in the entrance portion of the inclined rolls and the volume of material flow in the exit portion of the inclined rolls. In order to equalize the volume of material flow in the entrance portion of the inclined rolls and the volume of material flow in the exit portion of the inclined rolls, it is necessary to decrease the moving speed of the workpiece in the entrance portion. The volume of material flow at a particular position is expressed by the product of the multiplication of the cross-sectional area at the position by the moving speed of the workpiece at the position.

Then, the inventors conducted various experiments and numerical analyses to find out how to decrease the moving speed of the workpiece in the entrance portion of the inclined rolls. As a result, the inventors found that by increasing the angle of the entrance-side lateral surface of each of the inclined rolls, it becomes possible to decrease the moving speed of the workpiece in the entrance portion of the inclined rolls, which suppresses the fluctuation of the workpiece in circumferential length.

In the present specification, the angle of the entrance-side lateral surface of an inclined roll will be sometimes referred to as entrance-side lateral surface angle. The entrance-side lateral surface angle means, in a section including the pass line, the greatest value of angle between the pass line and the entrance-side lateral surface in the area where the entrance-side lateral surface is in contact with the workpiece.

Next, as a second countermeasure, the inventors attempted to control elongation of the workpiece in each direction during piercing rolling. A measure to do this is increasing the angle of the exit-side lateral surface of each of the inclined rolls. By increasing the angle of the exit-side lateral surface of each of the inclined rolls, it becomes possible to shorten the length, with respect to the length direction of the workpiece, of the area where the exit-side lateral surfaces of the inclined rolls are in contact with the workpiece, and thereby, the lengthwise restraint of the material becomes weak. Then, the workpiece elongates more easily in the length direction but less easily in the circumferential direction. Accordingly, the material of the workpiece becomes less likely to thrust into between adjacent inclined rolls.

In the present specification, the angle of the exit-side lateral surface of an inclined roll will be sometimes referred to as exit-side lateral surface angle. The exit-side lateral surface angle means, in a section including the pass line, the greatest value of angle between the pass line and the exit-side lateral surface in the area where the exit-side lateral surface is in contact with the workpiece.

By taking the above-described countermeasures and means, thin-walled tube making by using a three-roll-type inclined rolling mill, which have been thought impossible, becomes possible.

However, the above-described countermeasures and means are exclusive for thin-walled tube making. If these countermeasures and means are taken for thick-walled tube making, the following trouble will occur: the maximum-diameter portion of the plug is caught at the rear end of the produced hollow shell, and the plug cannot be taken out from the hollow shell. This is a kind of rolling trouble, and this trouble is called plug choking. The plug choking is a phenomenon that is caused by too short a circumferential length of the workpiece. In order to avoid the plug choking, the circumferential length of the workpiece must be sufficiently large, which is opposite to the condition desired for thin-walled tube making.

Thus, the means taken for thin-walled tube making are counter to the means taken for thin-walled tube making. Specifically, for thick-walled tube making, in order to ensure that the workpiece has a sufficiently large sectional area of the material at a place on the entrance side of the plug, the roll opening should be increased. In this case, in order to provide a propulsive force to the workpiece, it is necessary to increase the length of the area where the workpiece is in contact with the inclined rolls at the entrance portion of the inclined rolls. As a means to do this, the entrance-side lateral surface angle of each of the inclined rolls is decreased. Additionally, in order to allow the material of the workpiece to flow in the circumferential direction, the exit-side lateral surface angle of the inclined rolls should be decreased to strengthen the lengthwise restraint of the material.

In order to carry out thick-walled tube making and thin-walled tube making by using the same inclined rolling mill, inclined rolls that are mutually different in shape and dimensions should be used in the rolling mill, depending on the case. Thereby, the limits to the producible wall thickness in thick-walled tube making and in thin-wall tube making can be widened.

However, if the inclined rolls are exchanged according to the wall thickness of a seamless metal tube to be produced, the production efficiency inevitably becomes lower. Therefore, it is desired to avoid exchanges of the inclined rolls if possible.

The inventors further conducted a study on how to eliminate the need to exchange the inclined rolls. As a result, they found that a possible means for that is making the entrance-side lateral surface of each of the inclined rolls a convex surface. The entrance-side lateral surface of each of the inclined rolls is typically a taper surface with a constant gradient. As a means to produce seamless metal tubes with different wall thicknesses by using the same inclined rolls, the inventors conceived an idea of using inclined rolls each of which has a convex entrance-side lateral surface and adjusting the cross angle CA of each of the inclined rolls.

Now, the structure of the three-roll-type inclined rolling mill is described. The three-roll-type inclined rolling mill includes an entrance-side housing and an exit-side housing that support both ends of the center shafts of the respective inclined rolls. Either one or both of the two housings are rotated, and thereby, the feed angle FA of the inclined rolls is adjusted. The entrance-side housing and the exit-side housing are configured to adjust the entrance-side support points where the entrance-side housing supports the center shafts of the respective inclined rolls at the entrance side and the exit-side support points where the exit-side housing supports the center shafts of the respective inclined rolls at the exit side, respectively, independently of each other. By adjusting these support points separately, the cross angles of the inclined rolls are adjusted. Additionally, the roll opening at the entrance side and the roll opening at the exist side are adjusted separately. However, both ends of the center shafts of the respective inclined rolls may be supported by one housing.

Figure 5:
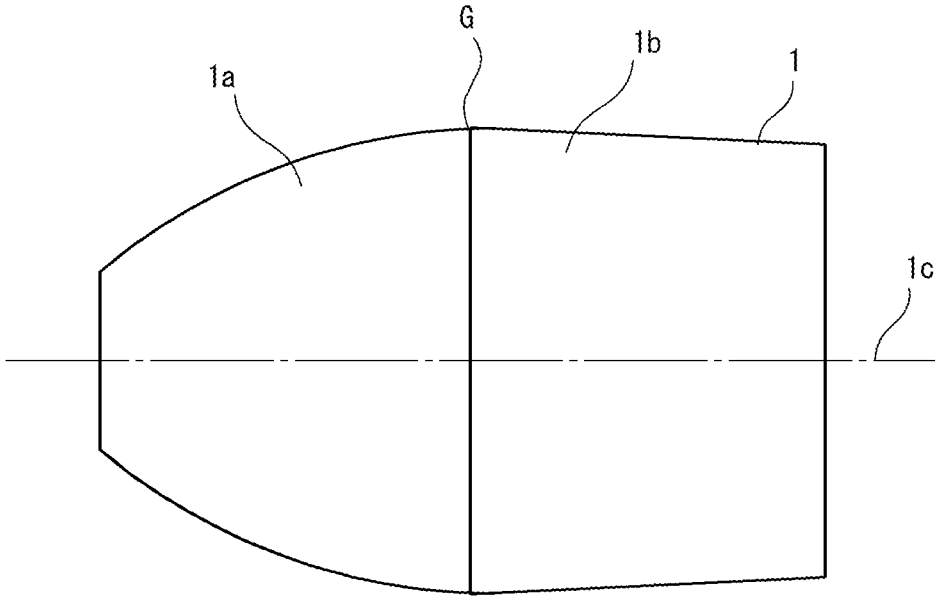
FIG. 5 is a diagram showing an exemplary inclined roll with a convex entrance-side lateral surface.

FIG. 5 is a diagram of an exemplary inclined roll 1 with a convex entrance-side lateral surface 1*a*. As shown FIG. 5, there is a gorge G at the boundary between the entrance-side lateral surface 1*a* and the exit-side lateral surface 1*b*. The entrance-side lateral surface 1*a* of the inclined roll 1 is not a simple taper surface, that is, not a taper surface with a constant gradient, but a convex surface. In the present specification, a convex surface means a taper surface of which gradient continuously changes, a taper surface of which gradient intermittently changes, or a taper surface that is a combination of these. When the entrance-side lateral surface 1*a* of the inclined roll 1 is cut along the central axis 1*c*, for example, a convexly curved line is seen. This convexly curved line is expressed, for example, by a function expressing a circular arc with a constant radius of curvature. This curved line may be expressed by a high-order polynomial function. When the entrance-side lateral surface 1*a* of the inclined roll 1 is cut along the central axis 1*c*, alternatively, a combination of a convexly curved line and a straight line may be seen, or a combination of a plurality of straight lines with different inclinations may be seen. On the other hand, the exit-side lateral surface 1*b* of the inclined roll 1 is a taper surface with a constant gradient.

A method for thin-walled tube making and thick-walled tube making by piercing rolling using inclined rolls with convex entrance-side lateral surfaces will be described below.

For thin-walled tube making, the cross angles CA of the inclined rolls are increased. Further, the roll opening is decreased. In this way, the inclined rolls are set closer to the pass line. Then, the contact start point where the workpiece comes into contact with the inclined rolls shifts toward the entrance along the pass line. Accordingly, the workpiece comes into contact with the entrance-side lateral surface of the inclined rolls at a position where the entrance-side lateral surfaces of the inclined rolls have a large gradient. This adjustment is beneficial also when a workpiece with a large diameter should be highly reduced.

By increasing the cross angles CA of the inclined rolls, the exit-side lateral surface angles of the inclined rolls are increased. However, the entrance-side lateral surface angles of the inclined rolls hardly change. This is because the entrance-side lateral surfaces of the inclined rolls are convex surfaces. In this case, if the entrance-side lateral surfaces of the inclined rolls are simple taper surfaces and entirely have a constant gradient, the trunk lengths of the entrance-side lateral surfaces must be lengthened preliminarily. As the cross angles CA of the inclined rolls become greater, the entrance-side lateral surface angles of the inclined rolls become smaller, and it is necessary to increase the roll opening at the entrance-side ends of the entrance-side lateral surfaces to a level equal to or more than the diameter of the workpiece. However, when the entrance-side lateral surfaces are convex surfaces, it is not necessary to do this. Also, even when the diameter of the workpiece is large, excess material pressing does not occur since the entrance-side lateral surfaces of the inclined rolls are convex surfaces, and the workpiece will be processed to be constant in circumferential length across its entire length. When the cross angles CA are changed, the plug may be changed.

The adjustment of the roll opening may be performed after the adjustment of the cross angles CA of the inclined rolls or before the adjustment of the cross angles CA of the inclined rolls. The adjustment of the roll opening and the adjustment of the cross angles CA of the inclined rolls may be repeated for fine adjustment.

For thick-walled tube making, adjustment is performed in the opposite manner to the adjustment for thin-walled tube making. Specifically, first, the cross angles CA of the inclined rolls are decreased. Further, the roll opening is increased. In this way, the inclined rolls are set farther from the pass line. Then, the contact start point where the workpiece comes into contact with the inclined rolls shifts toward the exist along the pass line. Accordingly, the workpiece comes into contact with the inclined rolls at a position where the entrance-side lateral surfaces of the inclined rolls have small gradients.

By decreasing the cross angles CA of the inclined rolls before adjusting the roll opening, the exit-side lateral surface angles of the inclined rolls are decreased. In this case, if the entrance-side lateral surfaces of the inclined rolls are simple taper surfaces and entirely have a constant gradient, as the cross angles CA of the inclined rolls become smaller, the entrance-side lateral surface angles become greater. Then, the length of the contact area where the workpiece is in contact with the entrance-side lateral surfaces of the inclined rolls becomes shorter, and the workpiece cannot come into engagement with the inclined rolls stably. However, when the entrance-side lateral surfaces are convex surfaces, the entrance-side lateral surface angle hardly changes, and no failures occur in getting the workpiece engagement with the inclined rolls. When the cross angles CA are changed, the plug may be changed.

As described above, when the entrance-side lateral surfaces of the inclined rolls are convex surfaces, it becomes possible to produce seamless metal tubes with different wall thicknesses by using the same inclined rolls only by changing the setup conditions of the inclined rolls. During the production process, even when the workpiece has a large diameter, the material is prevented from fluctuating in circumferential length, and rolling trouble, such as material thrusting, plug choking, etc. does not occur.

By taking appropriate countermeasures and means as described above, it is possible to produce a seamless metal tube, regardless of whether it is a thick-walled metal tube or a thin-walled metal tube, by inclination rolling (piercing rolling or elongating rolling) using a three-roll-type inclined rolling mill. The degree of wall thickness of the seamless metal tube is expressed by the ratio of wall thickness to outer diameter. This ratio is also referred to as wall-thickness to outer-diameter ratio. A small value of the wall-thickness to outer-diameter ratio indicates that the degree of wall thickness of the seamless metal tube is small, which means that the metal tube has a thin wall. It has been difficult to produce a thin-walled seamless metal tube with a wall-thickness to outer-diameter ratio of 0.07 or less by conventional piercing rolling using a three-roll-type inclined rolling mill. By taking the above-described countermeasures and means, it becomes possible to produce not only a thick-walled seamless metal tube but also a thin-walled seamless metal tube with a wall-thickness to outer-diameter ratio of 0.07 or less.

By taking the above-described countermeasures and means, it becomes possible to carry out piercing rolling for high degree of processing by using a large-outer-diameter round billet as the workpiece. Then, it is possible to consolidate the workpieces to large-outer-diameter round billets, which brings a beneficial effect that the costs for steel making and blooming are largely reduced.

A seamless metal tube production method according to the present invention has been made on the basis of the above-described findings.

In the seamless metal tube production method according to the present invention, a first seamless metal tube with a first wall thickness and a second seamless metal tube with a second wall thickness, which is different from the first wall thickness, are produced by use of an inclined rolling mill. The inclined rolling mill includes a plug and three inclined rolls. The plug is located on the pass line. The three inclined rolls are arranged equiangularly around the pass line, and each of the three inclined rolls have an entrance-side lateral surface and an exit-side lateral surface. The distance between the pass line and the entrance-side lateral surface decreases gradually with increasing distance from the entrance and with decreasing distance from the exit along the pass line. The distance between the pass line and the exit-side lateral surface increases gradually with increasing distance from the entrance and with decreasing distance from the exit along the pass line.

The production method above includes a first inclination rolling step, a setting changing step, and a second inclination rolling step. At the first inclination rolling step, a first heated workpiece is rolled by the inclined rolling mill. At the setting changing step, a setup condition of the inclined rolling mill is changed in a manner (a) or (b) as described below. At the second inclination rolling step, a second heated workpiece is rolled under the changed condition. (The structure of the production method having these features will be referred to as first process structure.)

(a) When the second wall thickness is smaller than the first wall thickness, the cross angle of each of the inclined rolls is made greater than the cross angle of each of the inclined rolls set for the first inclination rolling step.

(b) When the second wall thickness is larger than the first wall thickness, the cross angle of each of the inclined rolls is made smaller than the cross angle of each of the inclined rolls set for the first inclination rolling step.

The production method with the first process structure makes it possible to produce both a thin-walled seamless metal tube and a thick-walled seamless metal tube without causing any quality problems by using a three-roll-type inclined rolling mill. Thus, the three-roll-type inclined rolling mill can be put to practical use.

The first wall thickness and the second wall thickness are target values of wall thickness, and the actual wall thicknesses obtained after the inclination rolling may be slightly different from the target values designed as the first and second wall thicknesses.

In a typical example, the inclination rolling mill is a piercing-rolling mill. In this case, the first inclination rolling step and the second inclination rolling step are piercing-rolling steps. The first workpiece and the second workpiece are round solid billets.

In another typical example, the inclination rolling mill is an elongating-rolling mill. In this case, the first inclination rolling step and the second inclination rolling step are elongating-rolling steps. The first workpiece and the second workpiece are round hollow shells.

At the first inclination rolling step and the second inclination rolling step of the production method with the first process structure, the angle of the exit-side lateral surface in the contact area where the exit-side lateral surface is in contact with the workpiece (the exit-side lateral surface angle) is preferably equal to or more than 0 degrees and equal to or less than 9 degrees. At the first inclination rolling step, when the ratio of the first wall thickness to the outer diameter of the first seamless metal tube is 0.07 or less, the exit-side lateral surface angle is set more than 3 degrees. Similarly, at the second inclination rolling step, when the ratio of the second wall thickness to the outer diameter of the second seamless metal tube is equal to or less than 0.07, the exit-side lateral surface angle is set more than 3 degrees. (The structure of the production method further having this feature will be referred to as second process structure.)

The production method with the second process structure is beneficial when the first seamless metal tube is a thin-walled seamless metal tube or when the second seamless metal tube is a thin-walled seamless metal tube. Only if the exit-side lateral surface angle is set within the value range above, it is possible to produce a thin-walled metal tube as the first seamless metal tube or the second seamless metal tube without causing any quality problems. From the viewpoint of the onset of this effect, the exit-side lateral surface angle is preferably more than 3 degrees. Any upper limit is not particularly set to the exit-side lateral surface angle. However, in consideration of the design of the plug, the upper limit of the exit-side lateral surface angle is desirably 9 degrees, and more desirably 6 degrees.

In the production method with the first process structure or the second process structure, preferably, the entrance-side lateral surface is a convex surface, and the inclined rolls used at the first inclination rolling step are used also at the second inclination rolling step. (The structure of the production method further having these features will be referred to as third process structure.)

In the production method with the third process structure, exchanges of the inclined rolls for the first inclination step and for the second inclination step are not necessary. Thus, it becomes possible to produce the first seamless metal tube and the second seamless metal tube, which have different wall thicknesses, by using one inclined rolling mill, without exchanging the inclined rolls. Accordingly, the production efficiency is excellent.

In the production method with the first process structure or the second process structure, for example, the first workpiece and the second workpiece are solid. In other words, the first inclination rolling step and the second inclination rolling step may be piercing-rolling steps. In this case, at the first inclination step and at the second inclination step, when a piercing ratio of 3.5 or more is aimed at, preferably, the angle of the entrance-side lateral surface is set equal to or more than 8 degrees and equal to or less than 15 degrees, and the gorge draft ratio is set to 30% or higher. (The structure of the production method further having these features will be referred to as fourth process structure.)

The production method with the fourth process structure is beneficial when the first inclination rolling step and the second inclination rolling step are piercing-rolling steps. When piercing rolling with a high degree of processing, such as piercing rolling aiming at a piercing ratio of 3.5 or more, is carried out with the entrance-side lateral surface angle and the gorge draft ratio set within the ranges above, it is possible to produce the first seamless metal tube and the second seamless metal tube without causing any quality problems. From the viewpoint of the onset of this effect, the entrance-side lateral surface angle is preferably equal to or more than 8 degrees and equal to or less than 15 degrees. From the same viewpoint, the gorge draft ratio is preferably 30% or higher. Any upper limit is not particularly set to the gorge draft ratio. However, if the gorge draft ratio is large and if the sectional area of the material is small, the reaction force to the inclined rolls becomes large. In order to obtain sufficient bearing strength to support the shafts of the inclined rolls, the shafts of the inclined rolls must be sufficiently large, and accordingly, the diameters of the rolls must be sufficiently large. When the number of inclined rolls is three or more, the inclined rolls may be in contact with one another, and therefore, the upper limit of the gorge draft ratio is preferably 60%.

In the present specification, the piercing ratio means the ratio of the length of a seamless metal tube obtained by piercing rolling to the length of the workpiece before piercing rolling. Specifically, the piercing ratio at the first inclination rolling means the ratio of the length of the first seamless metal tube to the length of the first workpiece. The piercing ratio at the second inclination rolling means the ratio of the length of the second seamless metal tube to the length of the second workpiece. From another point of view, the piercing ratio means the ratio of the cross-sectional area of the workpiece before piercing rolling to the cross-sectional area of the seamless metal tube obtained by piercing rolling. Thus, the piercing ratio is an index of the degree of processing by piercing rolling. When the inclination rolling is elongating rolling, the piercing ratio is referred to as elongation ratio.

In the present specification, the gorge draft ratio (GD) [%] is defined by Formula (A) below, in which the outer diameter of the round billet used as the workpiece (DB) and the roll opening (RO) are used as parameters.

$$GD=(DB-RO)/DB\times 100 \quad (A)$$

In Formula (A), the roll opening (RO) means the roll opening degree at the roll gorge part, that is, at the boundary between the entrance-side lateral surface and the exit-side lateral surface of the roll. More exactly, the roll opening (RO) is a value that is double the shortest distance between the surface (for example, entrance-side lateral surface) of the roll and the pass line.

In the production method with any one of the first to third process structures, for example, the first workpiece and the second workpiece are solid. In other words, the first inclination rolling step and the second inclination rolling step may be piercing-rolling steps. In this case, preferably, the entrance-side lateral surface is a convex surface, and in a section of the inclined roll including the central axis of the inclined roll, a circular arc is seen as a line defining the entrance-side lateral surface. The value calculated by dividing the radius of curvature of the circular arc by the outer diameter of the first workpiece or the second workpiece is equal to or more than 1.67 and equal to or less than 6.67. (The structure of the production method further having this feature will be referred to as fifth process structure).

The production method with the fifth process structure is beneficial when the inclined rolling mill is a piercing-rolling mill and when the first inclination rolling step and the second inclination rolling step are piercing-rolling steps. In the present specification, when the entrance-side lateral surface is a convex surface and when a circular arc is seen as a line defining the entrance-side lateral surface in a section of the inclined roll along the central axis of the inclined roll, the value calculated by dividing the radius of curvature of the circular arc by the outer diameter of the round billet used as the workpiece is referred to as curved-surface index in some cases.

At the first inclination rolling step and at the second inclination rolling step, if the curved-surface index of the entrance-side lateral surface with respect to the first workpiece and the curved-surface index of the entrance-side lateral surface with respect to the second workpiece are within the range above, it is possible to produce the first seamless metal tube and the second seamless metal tube without causing any quality problems. From the viewpoint of the onset of this effect, the curved-surface index of the entrance-side lateral surface is preferably equal to or more than 1.67 and equal to or less than 6.67. However, if the radius of curvature, from which the curved-surface index of the entrance-side lateral surface is derived, is small, the material is rolled in a short contact area, and the surface of the inclined roll is abraded noticeably. If the radius of curvature is large, the trunk length of the entrance-side lateral surface of each inclined roll must be lengthened so that the workpiece can come into engagement with the inclined rolls certainly, which increases the facility cost and the production cost of the inclined rolls. Therefore, when a round billet with an outer diameter of 60 mm is used, the radius of curvature is preferably equal to or more than 150 mm and equal to or less than 350 mm. In this case, the preferred range for the curved-surface index is calculated to be equal to or more than 2.50 and equal to or less than 5.83.

In the production method with any one of the first to third process structures, for example, the first workpiece and the second workpiece are solid. In other words, the first inclination rolling step and the second inclination rolling step may be piercing-rolling steps. In this case, preferably, at the first inclination rolling step and at the second inclination rolling step, the gorge draft ratio (GD) and the engaging angle ($\alpha$) satisfy the condition expressed by Formula (1) below. (The structure of the production method further having this feature will be referred to as sixth process structure.)

$$0.12\times GD+1.5\leq\alpha\leq 0.25\times GD+6 \quad (1)$$

The gorge draft ratio (GD) in Formula (1) is defined by Formula (A) above. The engaging angle ($\alpha$) is defined as follows. A plane including both the central axis of the inclined roll and the pass line is established on the assumption that the feed angle FA of the inclined roll is 0 degrees. In the plane, a line connecting the contact start point where the workpiece (round billet) comes into contact with the inclined roll and the gorge point is drawn. The contact start point where the workpiece comes into contact with the inclined roll corresponds to an engaging point where the workpiece comes into engagement with the entrance-side lateral surface of the inclined roll. The angle between the line and the pass line is the engaging angle ($\alpha$).

The production method with the sixth process structure is beneficial when the inclined rolling mill is a piercing-rolling mill and when the first inclination rolling step and the second inclination rolling step are piercing-rolling steps. When the gorge draft ratio (GD) and the engaging angle ($\alpha$) satisfy the condition expressed by Formula (1), it is possible to produce the first seamless metal tube and the second seamless metal tube without causing any quality problems. In order to obtain this effect, as shown in Formula (1), the engaging angle ($\alpha$) is preferably equal to or more than "0.12×GD+1.5" and equal to or less than "0.25×GD+6". From another point of view, the gradient of the entrance-side lateral surface is set preferably in such a manner as to increase with decreasing distance from the entrance-side end of the entrance-side lateral surface so that the gorge draft ratio (GD) and the engaging angle ($\alpha$) can satisfy the condition expressed by Formula (1).

Figure 6:
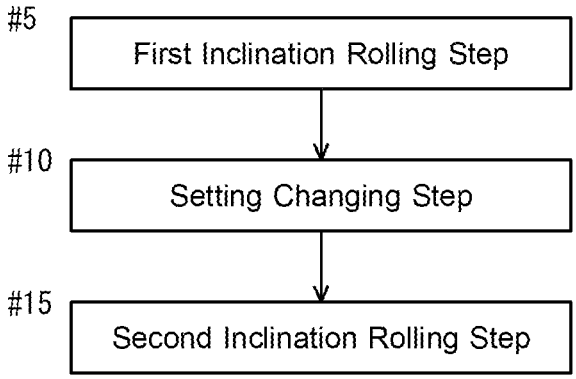
FIG. 6 is a flowchart showing a seamless metal tube production method according to an embodiment of the present invention.

With reference to the drawings, specific examples of the production method according to the present invention will hereinafter be described. FIG. 6 is a flowchart showing the seamless metal tube production method according to the present invention. As shown in FIG. 6, the production method according to the present invention includes a first inclination rolling step (#5), a setting changing step (#10), and a second inclination rolling step (#15).

[First Inclination Rolling Step (#5)]

At the first inclination rolling step (#5), a first workpiece is rolled by use of a three-roll-type inclined rolling mill to produce a first seamless metal tube with a first wall thickness. In advance of this, the first workpiece is heated to a predetermined temperature in a heating furnace. The workpiece is heated to a temperature, for example, in a range of 1150 to 1250 degrees C.

The first workpiece is a round billet. In this case, the inclined rolling mill is a piercing-rolling mill, and the round billet is pierced and rolled by the piercing-rolling mill. However, the first workpiece may be a hollow shell. The hollow shell may be a hollow shell produced by piercing rolling or may be produced by any other method. In this case, the inclined rolling mill is an elongating-rolling mill, and the hollow shell is elongated and rolled by the elongating-rolling mill.

[Second Inclination Rolling Step (#15)]

At the second inclination rolling step (#15), a second workpiece is rolled by the three-roll-type inclined rolling mill to produce a second seamless metal tube with a second wall thickness different from the first wall thickness. As in the case of first inclination rolling step, in advance of the second inclination rolling step, the second workpiece is heated to a predetermined temperature.

At the second inclination rolling step, the same inclined rolling mill used at the first inclination rolling step is used. The inclined rolling mill used at the first inclination rolling step and the second inclination rolling step include inclined rolls of which entrance-side lateral surfaces are convex surfaces as shown in FIG. 5. However, the entrance-side lateral surfaces of the inclined rolls may be taper surfaces with a constant gradient as shown in FIGS. 1 to 4. The exit-side lateral surfaces of the inclined rolls are taper surfaces with a constant gradient as shown in FIGS. 1 to 5. The distance between the pass line and the entrance-side lateral surface of each of the inclined rolls decreases gradually with increasing distance from the entrance and decreasing distance from the exit along the pass line. The distance between the pass line and the exit-side lateral surface of each of the inclined rolls increases gradually with increasing distance from the entrance and decreasing distance from the exit along the pass line.

If the first workpiece is a round billet, the second workpiece is a round billet. If the first workpiece is a hollow shell, the second workpiece is a hollow shell. When the second workpiece is a round billet, the round billet is pierced and rolled by the piercing-rolling mill. When the second workpiece is a hollow shell, the hollow shell is elongated and rolled by the elongating-rolling mill.

The shape and dimensions of the second workpiece are the same as the shape and dimensions of the first workpiece. However, the shape and dimensions of the second workpiece may be different from the shape and dimensions of the first workpiece. The material of the second workpiece is the same as the material of the first workpiece. However, the material of the second workpiece may be different from the material of the first workpiece.

[Setting Changing Step (#10)]

The setting changing step (#10) is performed after the first inclination rolling step (#5) and before the second inclination rolling step (#15) to change the setup condition of the inclined rolling mill in a manner (a) or (b) as described below. Thus, at the setting changing step (#10), based on the setup condition of the inclined rolling mill for the first inclination rolling step, the setup condition of the inclined rolling mill is changed to a condition appropriate for the second inclination rolling step.

(a) When the second wall thickness is smaller than the first wall thickness, the cross angle of each of the inclined rolls is made greater than the cross angle set for the first inclination rolling step.

(b) When the second wall thickness is greater than the first wall thickness, the cross angle of each of the inclined rolls is made smaller than the cross angle set for the first inclination rolling step.

Figure 7:
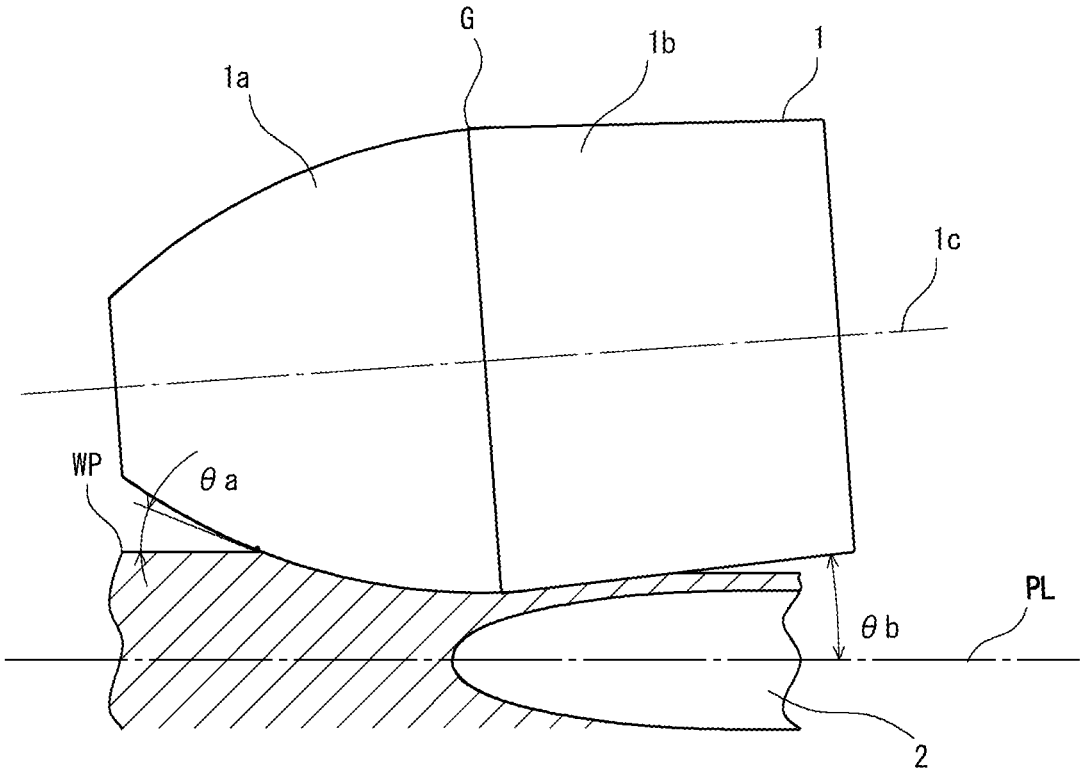
FIG. 7 is a diagram showing a manner of change (a) made at a setting changing step.
Figure 8:
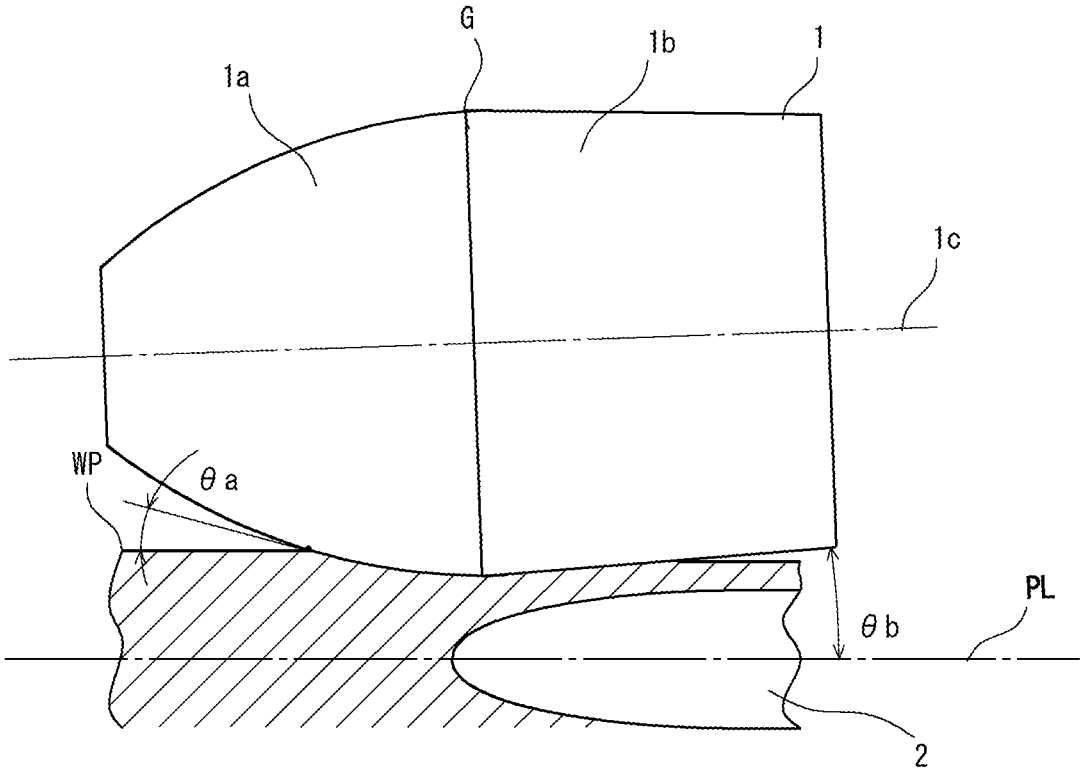
FIG. 8 is a diagram showing a manner of change (b) made at a setting changing step.

FIGS. 7 and 8 are diagrams showing specific examples of the setting changing step. FIG. 7 shows the manner of change (a). FIG. 8 shows the manner of change (b). FIGS. 7 and 8 show a case in which the entrance-side lateral surface 1*a* of each of the inclined rolls 1 is a convex surface.

In FIGS. 7 and 8, the entrance-side lateral surface 1*a* of the inclined roll 1 is a convex surface. When the entrance-side lateral surface 1*a* is cut along the central axis 1*c* of the inclined roll 1, a convexly curved line is seen. This convexly curved line can be expressed by a function that defines a circular curve with a constant radius of curvature. On the other hand, the exit-side lateral surface 1*b* of the inclined roll 1 is a taper surface.

The distance between the pass line PL and the entrance-side lateral surface 1*a* of the inclined roll 1 decreases gradually with increasing distance from the entrance and decreasing distance from the exit along the pass line PL. On the other hand, the distance between the pass line PL and the exit-side lateral surface 1*b* of the inclined roll 1 increases gradually with increasing distance from the entrance and decreasing distance from the exit along the pass line PL.

[Manner of Change (a)]

The manner (a) is taken when the second wall thickness is smaller than the first wall thickness. From another point of view, the manner (a) is taken when a thin-walled seamless metal tube is to be produced at the second inclination rolling step. In this case, the cross angle CA of each of the inclined rolls 1 is set greater than the cross angle CA set for the first inclination rolling step. Thereby, the exit-side lateral surface angle θb of each of the inclined rolls 1 becomes greater.

By changing the setup condition of the inclined rolling mill in the manner (a), excess material pressing does not occur at the second inclination rolling step to produce the second seamless metal tube, and the second workpiece WP is processed to be constant in circumferential length across its entire length. In this way, it becomes possible to produce a thin-walled seamless metal tube without causing any quality problems.

[Manner of Change (b)]

The manner (b) is taken when the second wall thickness is greater than the first wall thickness. From another point of view, the manner (b) is taken when a thick-walled seamless metal tube is to be produced at the second inclination rolling step. In this case, the cross angle CA of each of the inclined rolls 1 is set smaller than the cross angle CA set for the first inclination rolling step. Thereby, the exit-side lateral surface angle θb of each of the inclined rolls 1 becomes smaller.

By changing the setup condition of the inclined rolling mill in the manner (b), no failure in engagement of the workpiece with the inclined rolls occurs at the second inclination rolling step to produce the second seamless metal tube. In this way, it becomes possible to produce a thick-walled seamless metal tube without causing any quality problems.

Additionally, when the first workpiece and the second workpiece are the same in shape and dimensions, it is beneficial in the following point. The setup conditions of the facility (for example, a conveyer system) located upstream of the inclined rolling mill can be kept the same for the first inclination rolling step and for the second inclination rolling step. Accordingly, the production efficiency is excellent.

Example 1

In Example 1, a piercing-rolling test was conducted. In the piercing-rolling test, a carbon-steel round billet was used as a workpiece for rolling, and the carbon-steel round billet was pierced and rolled to be processed into a hollow shell (seamless metal tube). As possible components for the inclined rolling mill, a plurality of plugs with different dimensions and shapes (Plug Nos. A to F) were prepared. Also, a plurality of inclined rolls with different dimensions and shapes (Roll Nos. R60 to R600 and O to Z) were prepared.

Figure 9:
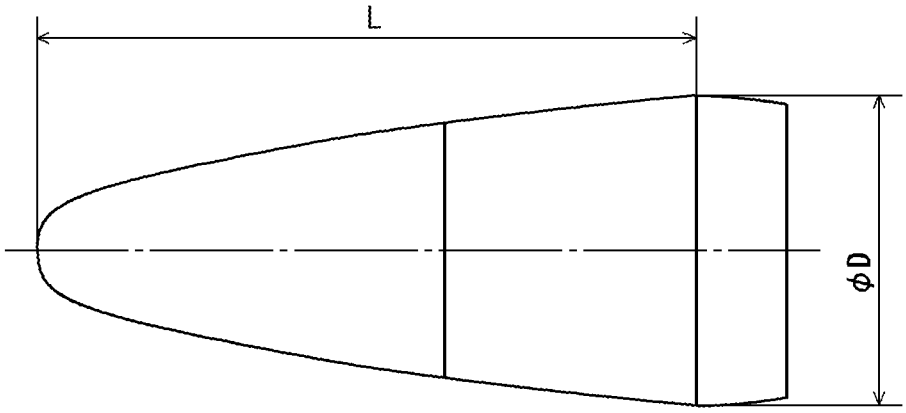
FIG. 9 is an external view of a plug that was used for a piercing-rolling test.

FIG. 9 is an external view of a plug that was used for the piercing-rolling test. As shown in FIG. 9, plugs 2 of Plug Nos. A to F each had the shape of a typical cannon shell. Table 1 below shows the dimensions of plugs 2 of Plug Nos. A to F. In Table 1, "L" denotes the length from the tip to the maximum-diameter point along the axis of the plug 2, as shown in FIG. 9. In Table 1, "D" denotes the maximum diameter of the trunk of the plug 2, as shown in FIG. 9.

TABLE 1

| Plug No. | D [mm] | L [mm] |
|---|---|---|
| A | 33.0 | 60 |
| B | 42.0 | 125 |
| C | 42.0 | 81 |
| D | 42.0 | 60 |
| E | 48.0 | 105 |
| F | 46.0 | 125 |

Figure 10:
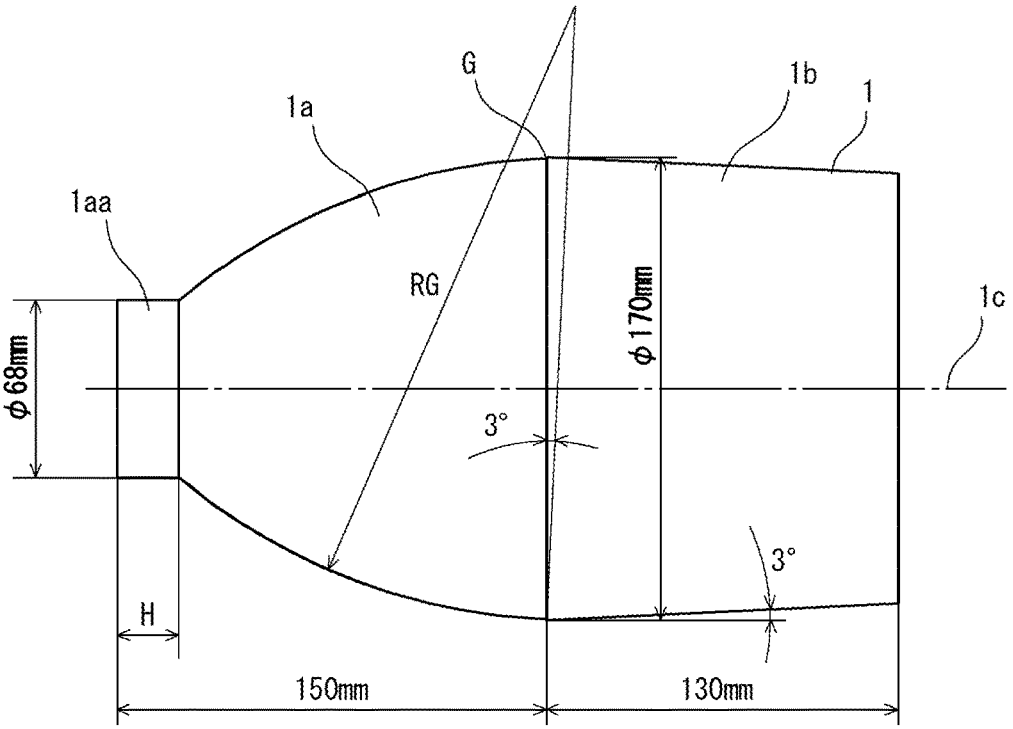
FIG. 10 is an external view of an inclined roll that was used for a piercing-rolling test.
Figure 11:
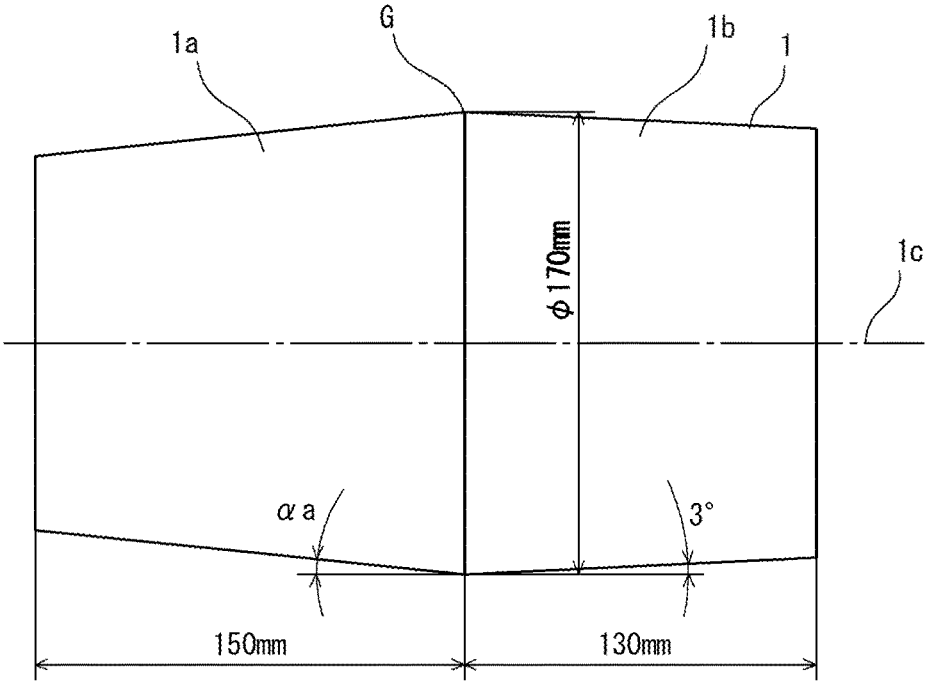
FIG. 11 is an external view of an inclined roll that was used for a piercing-rolling test.

FIGS. 10 and 11 are external views of inclined rolls that were used for the piercing-rolling test. FIG. 10 shows inclined rolls 1 of Roll Nos. R60 to R600. FIG. 11 shows inclined rolls 1 of Roll Nos. O to Z.

As shown in FIG. 10, the lateral surface of each inclined roll 1 of Roll Nos. R60 to R600 1 was divided into an entrance-side lateral surface 1*a* and an exit-side lateral surface 1*b* by a gorge G. The entrance-side lateral surface 1*a* was a convex surface. When the entrance-side lateral surface 1*a* was cut along the central axis 1*c* of the inclined roll 1, a convexly curved line was seen. This convex curved line was an arc with a constant radius of curvature (RG). The exit-side lateral surface 1*b* was a taper surface. The inclined rolls 1 of Roll Nos. R60 to R600 were the same in the overall length in the axial direction. The inclined rolls 1 of Roll Nos. R60 to R600 were the same in the length of the exit-side lateral surface 1*b* in the axial length. The inclined rolls 1 of Roll Nos. R60 to R600 were different in the length of the entrance-side lateral surface 1*a* in the axial direction, depending on the radius of curvature of the arc defining the convex surface (RG). Therefore, an auxiliary cylinder 1*aa* was attached to the entrance-side end of the entrance-side lateral surface 1*a* as needed.

Table 2 below shows the dimensions of Roll Nos. R60 to R600 that were used as the inclined rolls 1. FIG. 10 shows the dimensions that were common to Roll Nos. R60 to R600 of the inclined rolls 1. In Table 2, "RG" denotes the radius of curvature of the arc defining the convex surface of the entrance-side lateral surface 1*a*, as shown in FIG. 10. In Table 2, "H" denotes the length of the auxiliary cylinder 1*aa* in the axial direction, as shown in FIG. 10.

TABLE 2

| Roll No. | RG [mm] | H [mm] |
|---|---|---|
| R60 | 60 | 93.8 |
| R100 | 100 | 68.0 |
| R220 | 220 | 20.3 |
| R400 | 400 | 0.0 |
| R600 | 600 | 0.0 |

As shown in FIG. 11, the lateral surface of each inclined roll 1 of Roll Nos. O to Z was divided into the entrance-side lateral surface 1*a* and the exit-side lateral surface 1*b* by a gorge G. The entrance-side lateral surface 1*a* was a taper surface. The exit-side lateral surface 1*b* was a taper surface. The inclined rolls 1 of Roll Nos. O to Z were the same in the length of the entrance-side lateral surface 1*a* in the axial direction. The inclined rolls 1 of Roll Nos. O to Z were the same in the length of the exit-side lateral surface 1*b* in the axial direction. Accordingly, the inclined rolls 1 of Roll Nos. O to Z were the same in the overall length. The overall length of the inclined rolls 1 of Roll Nos. O to Z was the same as the overall length of the inclined rolls 1 of Roll Nos. R 60 to R600.

Table 3 below shows the dimensions of Roll Nos. O to Z. FIG. 11 shows the dimensions that were common to Roll Nos. O to Z used as the inclined rolls 1. In Table 3, "αa" denotes the gradient of the entrance-side lateral surface 1*a*, as shown in FIG. 11.

TABLE 3

| Roll No. | αa [°] |
|---|---|
| O | 1 |
| P | 4 |
| Q | 5 |
| R | 7 |
| S | 10 |
| T | 11 |
| U | 12 |
| V | 14 |
| W | 15 |
| X | 17 |
| Y | 18 |
| Z | 19 |

In the piercing-rolling test of Example 1, plugs of Plug Nos. A to D and inclined rolls of Roll Nos. O, P, R and S were used in various combinations for piercing rolling. In the test, the round billet was heated to 1200 degrees C. The feed angle FA of each of the inclined rolls was 10 degrees. The cross angle CA and the roll opening were varied.

It was attempted to produce hollow shells (seamless metal tubes) having the same outer diameter and different wall thicknesses. The reason is as follows. In practical operation, hollow shells produced by piercing rolling are sent to an elongating-rolling mill, and in most cases, the hollow shells should have the same outer diameter.

Table 4 below shows the test conditions and test results in Example 1.

TABLE 4

| | Roll | | | | | Gorge | Plug | | |
|---|---|---|---|---|---|---|---|---|---|
| | | Cross | Surface Angle [°] | | | Draft | | | |
| Condition | No. | Angle [°] | Entrance Side | Exit Side | Opening | Ratio [%] | Lead [mm] | No. | Diameter [mm] |
| 1 | O | −3.0 | 4.0 | 0.0 | 47.0 | 14.5 | 14.0 | A | 33.0 |
| 2 | O | −3.0 | 4.0 | 0.0 | 41.0 | 18.0 | 14.0 | A | 33.0 |
| 3 | P | 0.0 | 4.0 | 3.0 | 36.0 | 10.0 | 14.0 | B | 42.0 |
| 4 | P | 0.0 | 4.0 | 3.0 | 35.0 | 12.5 | 14.0 | B | 42.0 |
| 5 | P | 0.0 | 4.0 | 3.0 | 34.0 | 15.0 | 14.0 | B | 42.0 |
| 6 | R | 3.0 | 4.0 | 6.0 | 34.0 | 15.0 | 14.0 | C | 42.0 |
| 7 | R | 3.0 | 4.0 | 6.0 | 32.8 | 18.0 | 14.0 | C | 42.0 |
| 8 | R | 3.0 | 4.0 | 6.0 | 32.5 | 18.8 | 14.0 | C | 42.0 |
| 9 | S | 6.0 | 4.0 | 9.0 | 32.6 | 18.5 | 14.0 | D | 42.0 |
| 10 | S | 6.0 | 4.0 | 9.0 | 32.2 | 19.5 | 14.0 | D | 42.0 |
| 11 | S | 6.0 | 4.0 | 9.0 | 32.4 | 19.0 | 14.0 | D | 42.0 |
| 12 | S | 6.0 | 4.0 | 9.0 | 35.0 | 12.5 | 14.0 | D | 42.0 |
| 13 | R | 3.0 | 4.0 | 6.0 | 35.0 | 12.5 | 14.0 | C | 42.0 |
| 14 | P | 0.0 | 4.0 | 3.0 | 37.0 | 7.5 | 14.0 | B | 42.0 |
| 15 | P | 0.0 | 4.0 | 3.0 | 37.0 | 7.5 | 10.0 | B | 42.0 |
| 16 | O | −3.0 | 4.0 | 0.0 | 48.7 | 11.5 | 10.0 | A | 33.0 |

| | | Workpiece | Seamless Metal Tube | | | | | |
|---|---|---|---|---|---|---|---|---|
| Condition | Plug Length [mm] | Outer Diameter [mm] | Outer Diameter [mm] | Wall Thickness [mm] | t/D | Piercing Ratio | Rolling Trouble | Evaluation |
| 1 | 60 | 55 | 50.0 | 7.3 | 0.146 | 2.43 | | ○ |
| 2 | 60 | 50 | 50.0 | 4.3 | 0.086 | 3.18 | Thrusting | |
| 3 | 125 | 40 | 52.2 | 4.5 | 0.086 | 1.86 | | ○ |
| 4 | 125 | 40 | 52.3 | 4.0 | 0.076 | 2.07 | | ○ |
| 5 | 125 | 40 | 51.4 | 3.5 | 0.068 | 2.39 | Thrusting | |
| 6 | 81 | 40 | 51.2 | 3.5 | 0.068 | 2.40 | | ○ |
| 7 | 81 | 40 | 51.2 | 2.9 | 0.057 | 2.86 | | ○ |
| 8 | 81 | 40 | 51.2 | 2.7 | 0.053 | 3.05 | Thrusting | |
| 9 | 60 | 40 | 51.4 | 2.8 | 0.054 | 2.94 | | ○ |
| 10 | 60 | 40 | 51.2 | 2.7 | 0.053 | 3.05 | Thrusting | |
| 11 | 60 | 40 | 51.2 | 3.4 | 0.066 | 2.46 | | ○ |
| 12 | 60 | 40 | 51.3 | 4.0 | 0.078 | 2.11 | Plug choking | |
| 13 | 81 | 40 | 51.2 | 4.1 | 0.080 | 2.07 | Plug choking | |
| 14 | 125 | 40 | 52.8 | 5.1 | 0.097 | 1.64 | | ○ |
| 15 | 125 | 40 | 52.0 | 5.4 | 0.104 | 1.59 | Plug choking | |
| 16 | 60 | 55 | 50.5 | 8.2 | 0.162 | 2.18 | | ○ |

(Note)
"○" in Item "Evaluation" means excellent.

First, under Condition 1 that inclined rolls of Roll No. O and a plug of Plug No. A were used, piercing rolling was performed. Next, under Condition 2 that the roll opening was smaller than that in Condition 1, piercing rolling was performed. Condition 2 was to produce a seamless metal tube with a target value of wall thickness smaller than the target value of wall thickness under Condition 1. However, during piercing rolling conducted under Condition 2, material thrusting occurred. Therefore, the inclined rolls were replaced with inclined rolls of Roll No. P, the exit-side lateral surface angle was changed from 0 degrees to 3 degrees, and the plug was replaced with a plug of Plug No. B. Under these conditions (Condition 3), piercing rolling was performed. During piercing rolling under Condition 3, material thrusting or any other trouble did not occur, and a seamless metal tube with a wall thickness smaller than the wall thickness achieved under Condition 1 was obtained.

Under Condition 4 and under Condition 5, the roll opening was set smaller than that in Condition 3, and piercing rolling was performed to produce a seamless metal tube with a smaller wall thickness. By piercing rolling under Condition 4, a seamless metal tube with a wall thickness smaller than the wall thickness achieved under Condition 3 was obtained with no problem. On the other hand, during piercing rolling under Condition 5, material thrusting occurred. Therefore, the inclined rolls were replaced with inclined rolls of Roll No. R, the exit-side lateral surface angle was changed to 6 degrees, and the plug was replaced with a plug of Plug No. C. Under these conditions (Condition 6), piercing rolling was performed. By piercing rolling under Condition 6, a seamless metal tube with a wall thickness smaller than the wall thickness achieved under Condition 4 was obtained.

Under Condition 7 and under Condition 8, the roll opening was set smaller than that in Condition 6, and piercing rolling was performed to produce a seamless metal tube with a smaller wall thickness. By piercing rolling under Condition 7, a seamless metal tube with a wall thickness smaller than the wall thickness achieved under Condition 6 was obtained. On the other hand, during piercing rolling under Condition 8, material thrusting occurred. Therefore, the inclined rolls were replaced with inclined rolls of Roll No. S, the exit-side lateral surface angle was changed to 9 degrees, and the plug was replaced with a plug of Plug No. D. Under these conditions (Condition 9), piercing rolling was performed. By piercing rolling under Condition 9, a seamless metal tube with a wall thickness smaller than the wall thickness achieved under Condition 7 was obtained. Next, piercing rolling was performed under Condition 10 that the roll opening was smaller than that in Condition 9. During piercing rolling under Condition 10, material thrusting occurred.

Next, under Condition 11 and under Condition 12, the roll opening was set greater than that in Condition 9, and piercing rolling was performed to produce a seamless metal tube with a larger wall thickness. By piercing rolling under Condition 11, a seamless metal tube with a wall thickness larger than the wall thickness achieved under Condition 9 was obtained. During piercing rolling under Condition 12, plug choking occurred. Therefore, the inclined rolls were replaced with inclined rolls of Roll No. R, the exit-side lateral surface angle was changed from 9 degrees to 6 degrees, and the plug was replaced with a plug of Plug No. C. Under these conditions (Condition 13), piercing rolling was performed. However, Condition 13 could not solve the problem of plug choking.

Therefore, the inclined rolls were replaced with inclined rolls of Roll No. P, the exit-side lateral surface angle was set smaller, and the plug was replaced with a plug of Plug No. B. Under these conditions (Condition 14), piercing rolling was performed. By piercing rolling under Condition 14, a seamless metal tube with a wall thickness larger than the wall thickness achieved by Condition 11 was obtained. Under Condition 15 that the plug lead was set smaller, piercing rolling was performed to produce a seamless metal tube with a larger wall thickness. During piercing rolling under Condition 15, plug choking occurred. Therefore, the inclined rolls were replaced with inclined rolls of Roll No. O, the exit-side lateral surface angle was set smaller, and the plug was replaced with a plug of Plug No. A. Under these conditions (Condition 16), piercing rolling was performed. By piercing rolling under Condition 16, a seamless metal tube with a wall thickness larger than the wall thickness achieved by Condition 14 was obtained.

The following is derived from the results described above. The following discussion is of a process of producing a first seamless metal tube with a first wall thickness by piercing rolling and thereafter producing a second seamless metal tube with a second wall thickness different from the first wall thickness by piercing rolling. When the second wall thickness of the second seamless metal tube is smaller than the first wall thickness, it is possible to produce the second thin-walled seamless metal tube without causing no quality problems by increasing the exit-side lateral surface angle of each of the inclined rolls. It is possible to increase the exit-side lateral surface angle by increasing the cross angle of each of the inclined rolls. On the other hand, when the second wall thickness is larger than the first wall thickness, it is possible to produce the second thick-walled seamless metal tube without causing no quality problems by decreasing the exit-side lateral surface angle of each of the inclined rolls. It is possible to decrease the exit-side lateral surface angle by decreasing the cross angle of each of the inclined rolls. Thus, by the production method with the above-described first process structure, it is possible to produce a seamless metal tube, whether it has a small wall thickness or a large wall thickness, without causing any quality problems.

Figure 12:
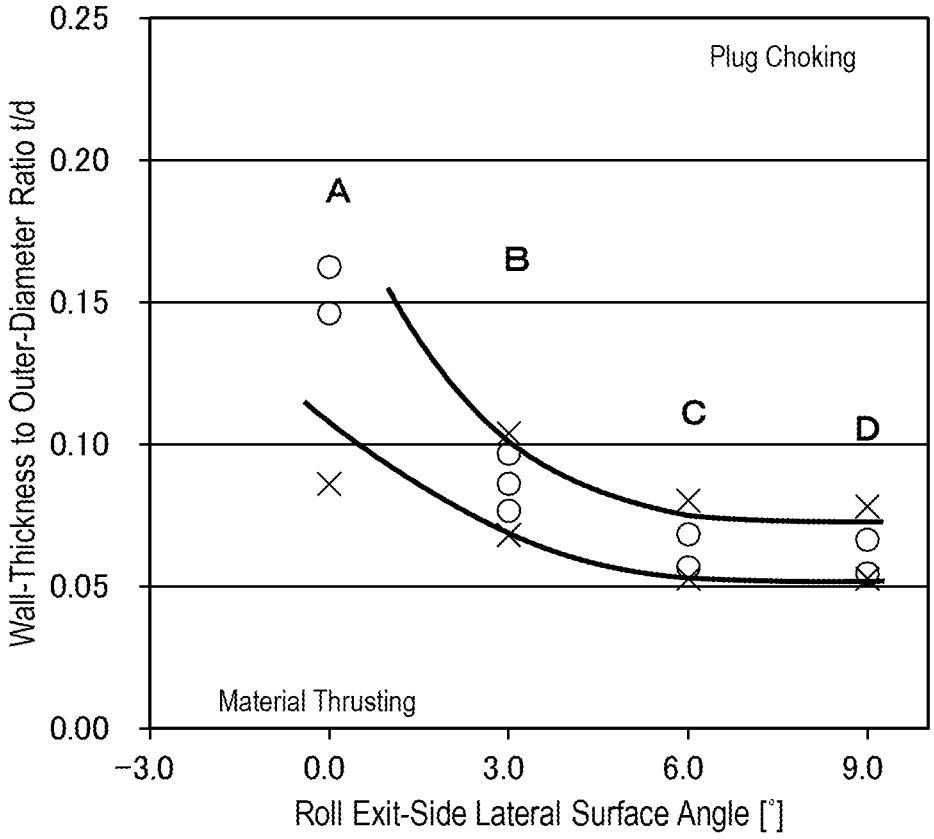
FIG. 12 is a graph showing the occurrence/non-occurrence of failures in EXAMPLE 1.

It was sorted out whether any failure (material thrusting or plug choking) occurred or not during piercing rolling under each of Conditions 1 to 16. The sort-out was conducted with respect to the exit-side lateral surface angle of each of the inclined rolls and the wall-thickness to outer-diameter ratio of the seamless metal tube. FIG. 12 is a graph showing the occurrence/non-occurrence of failures in Example 1. In the graph of FIG. 12, the horizontal axis indicates the exit-side lateral surface angle [°] of each of the inclined rolls, and the vertical axis indicates the wall-thickness to outer-diameter ratio (t/d) [unit: non-dimensional] of the seamless metal tube. In FIG. 12, "○" means that no failure occurred, and "x" means that a failure occurred. In FIG. 12, "A", "B", "C" and "D" are plug numbers.

The following is derived from the results shown in FIG. 12. As the exit-side lateral surface angle of each of the inclined rolls is increasing, the wall-thickness to outer-diameter ratio that causes material thrusting becomes smaller. This means that an increase in the exit-side lateral surface angle leads to prevention of material thrusting and widening of the marginal wall thickness in thin-walled tube making. On the other hand, as the exit-side lateral surface angle of each of the inclined rolls is decreasing, the wall-thickness to outer-diameter ratio that causes plug choking becomes greater. This means that a decrease in the exit-side lateral surface angle leads to prevention of plug choking and widening of the marginal wall thickness in thick-walled tube making.

In order to produce a thin-walled seamless metal tube with a wall-thickness to outer-diameter ratio of 0.07 or less with no problem (without causing material thrusting), the exit-side lateral surface angle should be set more than 3 degrees. No upper limit is set to the exit-side lateral surface angle. The marginal wall thickness in thin-walled tube making is almost the same whether the exit-side lateral surface angle is 6 degrees or 9 degrees. When the exit-side lateral surface angle is set more than 9 degrees, the plug must be shortened geometrically. In this case, the design of the plug is difficult, and there is a risk of degradation in dimensional accuracy, especially a risk of more uneven wall thickness. Therefore, the upper limit of the exit-side lateral surface angle is desirably 9 degrees, and more desirably 6 degrees.

Either in thin-walled tube making or in thick-walled tube making, when the exit-side lateral surface angle is set less than 0 degrees, the roll opening becomes smaller with decreasing distance from the exit of the inclined rolls. In this case, the clearance between the inner circumference of the produced seamless metal tube and the outer circumference of the plug is too small, and it is difficult to pull out the plug from the seamless metal tube. Therefore, the exit-side lateral surface angle is preferably 0 degrees or more. Thus, the production method with the above-described second process structure makes it possible to produce a seamless metal tube, whether it has a small wall thickness or a large wall thickness, without causing any quality problems.

Example 2

An exchange of inclined rolls requires a long-time rest of the equipment and leads to a decrease in production efficiency. Therefore, the maximum effort should be taken to avoid exchanges of inclined rolls.

In Example 2, a piercing-rolling test was conducted in the same manner as in Example 1. In the piercing-rolling test of Example 2, plugs of Plug Nos. A to D and inclined rolls of Roll Nos. V, P and R220 were used in various combinations for piercing rolling.

Table 5 below shows the test conditions and test results in Example 2.

TABLE 5

| | Roll | | | | | Gorge Draft | Plug | | |
|---|---|---|---|---|---|---|---|---|---|
| | | Cross | Surface Angle [°] | | | | | | |
| Condition | No. | Angle [°] | Entrance Side | Exit Side | Opening | Ratio [%] | Lead [mm] | No. | Diameter [mm] |
| 17 | V | −3.0 | 17.0 | 0.0 | 47.0 | 14.5 | 14.0 | A | 33.0 |
| 18 | P | −3.0 | 7.0 | 0.0 | 47.0 | 14.5 | 14.0 | A | 33.0 |
| 19 | P | 0.0 | 4.0 | 3.0 | 36.0 | 10.0 | 14.0 | B | 42.0 |
| 20 | P | 0.0 | 4.0 | 3.0 | 35.0 | 12.5 | 14.0 | B | 42.0 |
| 21 | P | 3.0 | 1.0 | 6.0 | 34.0 | 15.0 | 14.0 | C | 42.0 |
| 22 | R220 | −3.0 | R220 | 0.0 | 47.0 | 14.5 | 14.0 | A | 33.0 |
| 23 | R220 | 0.0 | R220 | 3.0 | 36.0 | 10.0 | 14.0 | B | 42.0 |
| 24 | R220 | 0.0 | R220 | 3.0 | 35.0 | 12.5 | 14.0 | B | 42.0 |
| 25 | R220 | 3.0 | R220 | 6.0 | 34.0 | 15.0 | 14.0 | C | 42.0 |
| 26 | R220 | 3.0 | R220 | 6.0 | 32.8 | 18.0 | 14.0 | C | 42.0 |
| 27 | R220 | 6.0 | R220 | 9.0 | 32.6 | 18.5 | 14.0 | D | 42.0 |
| 28 | R220 | 6.0 | R220 | 9.0 | 32.4 | 19.0 | 14.0 | D | 42.0 |
| 29 | R220 | 0.0 | R220 | 3.0 | 37.0 | 7.5 | 14.0 | B | 42.0 |
| 30 | R220 | −3.0 | R220 | 0.0 | 48.7 | 11.5 | 10.0 | A | 33.0 |

| | | Workpiece | Seamless Metal Tube | | | | | |
|---|---|---|---|---|---|---|---|---|
| Condition | Plug Length [mm] | Outer Diameter [mm] | Outer Diameter [mm] | Wall Thickness [mm] | t/D | Piercing Ratio | Rolling Trouble | Evaluation |
| 17 | 60 | 55 | | | | | Engagement failure | |
| 18 | 60 | 55 | 50.1 | 7.3 | 0.146 | 2 42 | | ○ |
| 19 | 125 | 40 | 52.4 | 4.5 | 0.086 | 1.86 | | ○ |
| 20 | 125 | 40 | 52.6 | 4.0 | 0.076 | 2.06 | | ○ |
| 21 | 81 | 40 | | | | | Too short roll trunk length | |
| 22 | 60 | 55 | 50.1 | 7.2 | 0.144 | 2.45 | | ○ |
| 23 | 125 | 40 | 52.4 | 4.4 | 0.084 | 1.89 | | ○ |
| 24 | 125 | 40 | 52.5 | 4.0 | 0.076 | 2.06 | | ○ |
| 25 | 81 | 40 | 51.3 | 3.6 | 0.070 | 2.33 | | ○ |
| 26 | 81 | 40 | 51.4 | 3.0 | 0.058 | 2.75 | | ○ |
| 27 | 60 | 40 | 51.4 | 2.9 | 0.056 | 2.84 | | ○ |
| 28 | 60 | 40 | 51.2 | 3.4 | 0.066 | 2.46 | | ○ |
| 29 | 125 | 40 | 52.8 | 5.0 | 0.095 | 1.67 | | ○ |
| 30 | 60 | 55 | 50.5 | 8.2 | 0.162 | 2.18 | | ○ |

(Note)
"○" in Item "Evaluation" means excellent.

First, piercing rolling was performed under Condition 17 that inclined rolls of Roll No. V and a plug of Plug No. A were used. Condition 17 was the same as Condition 1 in Example 1, except for the entrance-side lateral surface angle of each of the used inclined rolls. During piercing rolling under Condition 17, however, the round billet did not come into engagement with the inclined rolls.

Therefore, piercing rolling was performed under Conditions 18 to 21. Under Conditions 18 to 21, inclined rolls of Roll No. P were used, and the results of piercing rolling under Conditions 18 to 21 show that a workpiece having almost the same dimensions with the workpiece of piercing rolling under Condition 1 can be pierced and rolled under any of Conditions 18 to 21. Condition 19 and Condition 20 corresponded to Condition 3 and Condition 4 in Example 1, respectively. The results of piercing rolling under Condition 19 and Condition 20 show that a workpiece can be pierced and rolled to have a smaller wall thickness and a still smaller wall thickness. In Example 1, piercing rolling under Condition 5 that inclined rolls of Roll No. P and a plug of Plug No. B were used in combination did not allow the workpiece to be processed to have a still smaller wall thickness. Therefore, for Condition 21, a combination of inclined rolls of Roll No. P and a plug of Plug No. C was used, and the exit-side lateral surface angle was set to the same exit-side lateral surface angle for Condition 6 in Example 1 to aim at the same wall thickness as aimed at in piercing rolling under Condition 6 in Example 1. However, during piercing rolling under Condition 21, the round billet hit against the entrance-side ends of the inclined rolls and could not come into engagement with the inclined rolls. The reason was as follows. The entrance-side lateral surface angle of each of the inclined rolls was 1 degree, and therefore, the trunk length (length in the axial direction) of each of the inclined rolls was too short.

For thin-walled tube making, in the first place, the exit-side lateral surface angle of each of the inclined rolls is set large, and inevitably, the entrance-side lateral surface angle becomes smaller. For thin-walled tube making, additionally, the roll opening should be small, which requires the trunk length of the entrance-side lateral surface to be increased. For piercing rolling under Condition 23, the entrance-side lateral surface of each of the inclined rolls is required to have a trunk length of 170 mm or more for engagement of the round billet with the inclined rolls. The entrance-side lateral surface of each of the inclined rolls that were used in the test had a trunk length of 150 mm (see FIG. 11).

If the entrance-side lateral surfaces of the inclined rolls have too long a trunk length, the construction cost for the inclined rolling mill and the production cost for the tools become higher. Therefore, it is not good to increase the trunk length of the entrance-side lateral surface of each of the inclined rolls.

Then, piercing rolling was performed under Conditions 22 to 30. For piercing rolling under Conditions 22 to 30, the inclined rolls were replaced with inclined rolls of Roll No. R220, and different plugs were used. The cross angle CA of each of the inclined rolls and the roll opening were set to various values. Piercing rolling was performed under Condition 22 to Condition 30 in the same order as in Example 1. Specifically, in piercing rolling under the same conditions, a seamless metal tube with a small wall thickness was produced, and thereafter a seamless metal tube with a large wall thickness was produced. During piercing rolling under any of Conditions 22 to 30, a seamless metal tube could be produced without having an engagement failure or any other failure.

These results show the following. When the entrance-side lateral surface of each of the inclined rolls is a convex surface, it is possible to produce a thin-walled seamless metal tube and a thick-walled seamless metal tube without causing any quality problems, with no need of exchanging the inclined rolls.

Example 3

In Example 3, a piercing-rolling test was conducted in the same manner as in Example 1. In the piercing-rolling test of Example 3, plugs of Plug Nos. C and E and inclined rolls of Roll Nos. S to Z and R220 were used in various combinations, and piercing rolling for high degree of processing with a piercing ratio of 3.5 or more was carried out. Two types of round billets, one of which had an outer diameter of 50 mm and the other of which had an outer diameter of 60 mm, were used.

The cross angle CA of each of the inclined rolls was 3 degrees, and the feed angle FA of each of the inclined rolls was 10 degrees. The exit-side lateral surface angle of each of the inclined rolls was 6 degrees. It was checked whether any failure or problem (material thrusting, engagement failure, or fluctuation in the circumferential length of material) occurred while the roll opening was varied. This checking was conducted with respect to the entrance-side lateral surface angle of each of the inclined rolls and the gorge draft ratio.

Table 6 below shows the test conditions and test results in Example 3.

TABLE 6

| | Roll | | | | | | Plug | | |
|---|---|---|---|---|---|---|---|---|---|
| | | Cross | Surface Angle [°] | | | Gorge Draft | | | |
| Condition | No. | Angle [°] | Entrance Side | Exit Side | Opening | Ratio [%] | Lead [mm] | No. | Diameter [mm] |
| 31 | S | 3.0 | 7.0 | 6.0 | 33.5 | 44.2 | 18.0 | E | 48.0 |
| 32 | S | 3.0 | 7.0 | 6.0 | 34.0 | 32.0 | 14.0 | C | 42.0 |
| 33 | T | 3.0 | 8.0 | 6.0 | 34.0 | 32.0 | 14.0 | C | 42.0 |
| 34 | U | 3.0 | 9.0 | 6.0 | 29.8 | 50.3 | 4.0 | E | 48.0 |
| 35 | V | 3.0 | 11.0 | 6.0 | 35.5 | 29.0 | 18.0 | C | 42.0 |
| 36 | V | 3.0 | 11.0 | 6.0 | 33.5 | 33.0 | 18.0 | C | 42.0 |
| 37 | W | 3.0 | 12.0 | 6.0 | 29.8 | 40.4 | 18.0 | C | 42.0 |
| 38 | X | 3.0 | 14.0 | 6.0 | 35.0 | 30.0 | 18.0 | C | 42.0 |
| 39 | X | 3.0 | 14.0 | 6.0 | 36.0 | 28.0 | 22.0 | C | 42.0 |
| 40 | Y | 3.0 | 15.0 | 6.0 | 29.8 | 50.3 | 4.0 | E | 48.0 |
| 41 | Y | 3.0 | 15.0 | 6.0 | 34.0 | 32.0 | 14.0 | C | 42.0 |
| 42 | Z | 3.0 | 16.0 | 6.0 | 34.0 | 32.0 | 14.0 | C | 42.0 |
| 43 | Z | 3.0 | 16.0 | 6.0 | 33.5 | 44.2 | 18.0 | E | 48.0 |
| 44 | R220 | 3.0 | R220 | 6.0 | 34.0 | 32.0 | 14.0 | C | 42.0 |
| 45 | R220 | 3.0 | R220 | 6.0 | 36.0 | 28.0 | 22.0 | C | 42.0 |

| | | Workpiece | Seamless Metal Tube | | | | | |
|---|---|---|---|---|---|---|---|---|
| Condition | Plug Length [mm] | Outer Diameter [mm] | Outer Diameter [mm] | Wall Thickness [mm] | t/D | Piercing Ratio | Rolling Trouble | Evaluation |
| 31 | 105 | 60 | 59.5 | 2.9 | 0.049 | 5.48 | Large fluctuation in Circumference | |
| 32 | 81 | 50 | 51.4 | 3.6 | 0.070 | 3.63 | Large fluctuation in Circumference | |
| 33 | 81 | 50 | 51.5 | 3.5 | 0.068 | 3.72 | OK | ○ |
| 34 | 105 | 60 | 59.5 | 2.9 | 0.049 | 5.48 | OK | ○ |
| 35 | 81 | 50 | 51.3 | 3.9 | 0.076 | 3.38 | Thrusting | |
| 36 | 81 | 50 | 51.3 | 2.9 | 0.057 | 4.45 | OK | ○ |
| 37 | 81 | 50 | 51.2 | 3.4 | 0.066 | 3.85 | OK | ○ |
| 38 | 81 | 50 | 51.3 | 3.6 | 0.070 | 3.64 | OK | ○ |
| 39 | 81 | 50 | 51.3 | 3.7 | 0.072 | 3.55 | Thrusting | |
| 40 | 105 | 60 | 59.6 | 2.9 | 0.049 | 5.47 | OK | ○ |
| 41 | 81 | 50 | 51.4 | 3.5 | 0.068 | 3.73 | OK | ○ |
| 42 | 81 | 50 | 51.2 | 3.6 | 0.070 | 3.65 | Engagement failure | |

TABLE 6-continued

| | | | | | | | | |
|---|---|---|---|---|---|---|---|---|
| 43 | 105 | 60 | 59.6 | 2.9 | 0.049 | 5.47 | Engagement failure | |
| 44 | 81 | 50 | 51.2 | 3.6 | 0.070 | 3.65 | OK | ○ |
| 45 | 81 | 50 | 51.4 | 3.7 | 0.072 | 3.54 | Thrusting | |

(Note)
"○" in Item "Evaluation" means excellent.

Figure 13:
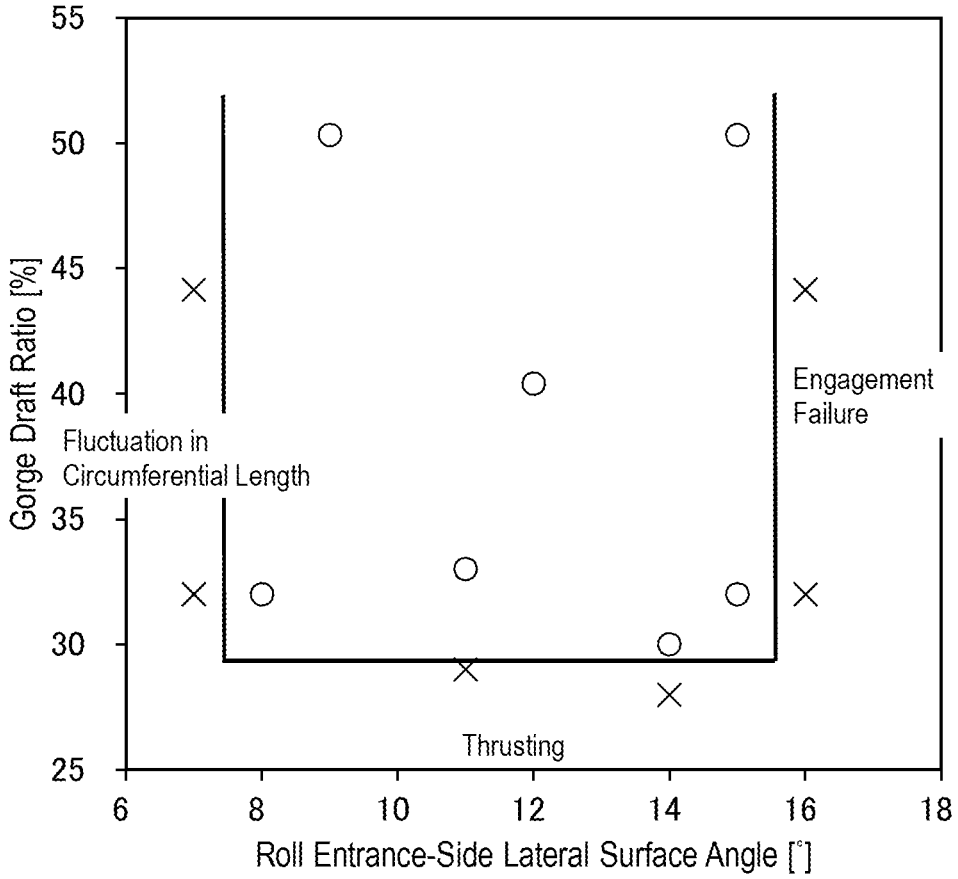
FIG. 13 is a graph showing the occurrence/non-occurrence of failures in EXAMPLE 3.

FIG. 13 is a graph showing the occurrence/non-occurrence of failures in Example 3. In the graph of FIG. 13, the horizontal axis indicates the entrance-side lateral surface angle [°] of each of the inclined rolls, and the vertical axis indicates the gorge draft ratio [%]. In FIG. 13, "○" means that no failure occurred, and "x" means that a failure occurred.

As shown in Table 6 and FIG. 13, when the entrance-side lateral surface angle of each of the inclined rolls was 7 degrees or less, the circumferential length of the material fluctuated largely depending on the position with respect to the length direction. On the other hand, when the entrance-side lateral surface angle of each of the inclined rolls was 16 degrees or more, an engagement failure occurred. When the gorge draft ratio was less than 30%, material thrusting occurred. Therefore, for piercing rolling with a piercing ratio of 3.5 or more, the entrance-side lateral surface angle should be set equal to or more than 8 and equal to or less than 15 degrees, and the draft ratio should be set to 30% or more.

It was confirmed that even when inclined rolls of Roll No. R220 were used, that is, even when inclined rolls, each having a convex entrance-side lateral surface, were used, the gorge draft ratio of 30% or less caused thrusting during piercing rolling with a piercing ratio of 3.5 or more.

Example 4

In Example 4, a piercing-rolling test was conducted in the same manner as in Example 1. In the piercing-rolling test of Example 4, plugs of Plug Nos. A, E and F and five kinds of inclined rolls (Roll Nos. R60 to R600) were used in various combinations, and piercing rolling was performed. Three different conditions, Condition 46 to Condition 48, were set as basic conditions. Under each of Conditions 46 to 48, additionally, all the five kinds of rolls (Roll Nos. R60 to R600) were used one kind at a time. Each of Conditions 46, 47 and 48 was to produce a thick-walled seamless metal tube, a medium-walled seamless metal tube, and a thin-walled seamless metal tube. Under Condition 46, Condition 47 and Condition 48, the exit-side lateral surface angle was 0 degrees, 3 degrees and 6 degrees, respectively.

It was checked whether any failure occurred or not during piercing rolling under each Condition. The checking was conducted with respect to the contact start point where the round billet comes into contact with the inclined rolls. The contact start point can be calculated by two-dimensional geometry on the assumption that the feed angle FA of each of the inclined rolls is 0 degrees. The contact start point is defined by a first distance along the pass line and a second distance in a direction perpendicular to the pass line. The first distance was the distance between the gorge point to the contact start point. The second distance was the distance calculated by subtracting a half of the roll opening from the distance between the pass line and the contact start point. In the present specification, the first distance will be sometimes referred to as distance from gorge. The second distance will be sometimes referred to as (distance from pass line)−(roll opening/2).

Table 7 below shows the test results in Example 4.

TABLE 7

| | Roll | | | | | | | | | Workpiece | Seamless Metal Tube | | | |
|---|---|---|---|---|---|---|---|---|---|---|---|---|---|---|
| | Cross | Surface Angle [°] | | | Gorge Draft | Plug | | | | Outer | Outer | Wall | | |
| Condition | Angle [°] | Entrance Side | Exit Side | Opening | Ratio [%] | Lead [mm] | No. | Diameter [mm] | Length [mm] | Diameter [mm] | Diameter [mm] | Thickness [mm] | t/D | Piercing Ratio |
| 46 | −3.0 | R | 0.0 | 54.6 | 9.0 | 10.0 | A | 33.0 | 60 | 60 | 56.0 | 11.0 | 0.196 | 1.82 |
| 47 | 0.0 | R | 3.0 | 42.3 | 29.5 | 15.5 | F | 46.0 | 125 | 60 | 57.8 | 5.0 | 0.087 | 3.41 |
| 48 | 3.0 | R | 6.0 | 30.0 | 50.0 | 3.0 | E | 48.0 | 81 | 60 | 58.7 | 3.1 | 0.053 | 5.22 |

Figure 14:
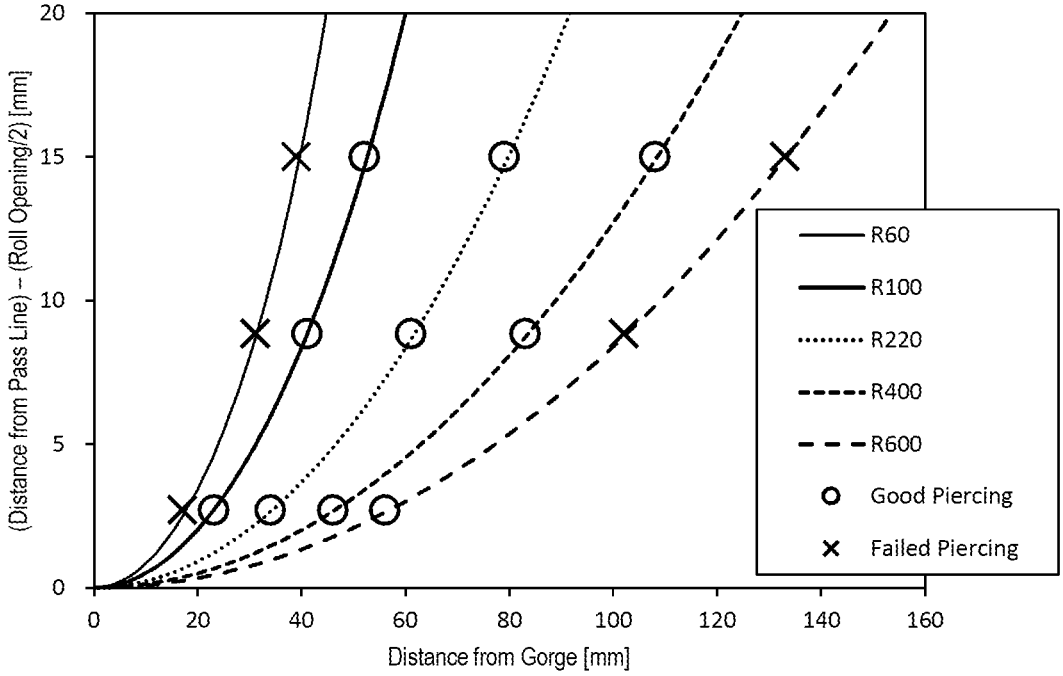
FIG. 14 is a graph showing the occurrence/non-occurrence of failures in EXAMPLE 4.

FIG. 14 is a graph showing the occurrence/non-occurrence of failures in Example 4. In the graph of FIG. 14, the horizontal axis indicates distance from gorge [mm], and the vertical axis indicates (distance from pass line)−(roll opening/2) [mm]. In FIG. 14, "○" means that no failure occurred, and "x" means that a failure occurred.

As shown in FIG. 14, when rolls of Roll No. R60 were used as the inclined rolls, under any of Conditions 46 to 48, an engagement failure occurred. When rolls of Roll No. R600 were used as the inclined rolls, under each of Condition 47 and Condition 48, the material fluctuated largely in circumferential length.

These results show the following. In order to prevent occurrence of failures, it is preferred to choose Roll Nos. R100 to R400 from among Roll Nos. R60 to R600 as the inclined rolls. When rolls of Roll No. R100, which is the smallest type among Roll Nos. R100 to R400, were used as the inclined rolls, the radius of curvature of the arc defining the convex entrance-side lateral surface of each of the inclined rolls was 100 mm. When rolls of Roll No. R400, which is the largest type among Roll Nos. R100 to R400, were used as the inclined rolls, the radius of curvature of the arc defining the convex entrance-side lateral surface of each of the inclined rolls was 400 mm. The outer diameter of the round billet was 60 mm. Accordingly, when the value calculated by dividing the radius of curvature of the arc defining the convex entrance-side lateral surface by the outer diameter of the round billet (the curved-surface index of the entrance-side lateral surface) is equal to or more than 1.67 and equal to or less than 6.67, occurrence of failures can be suppressed.

Example 5

In Example 5, a piercing-rolling test was conducted in the same manner as in Example 1. In the piercing-rolling test of Example 5, two more kinds of inclined rolls (Roll Nos. A and B) were used.

Figure 15:
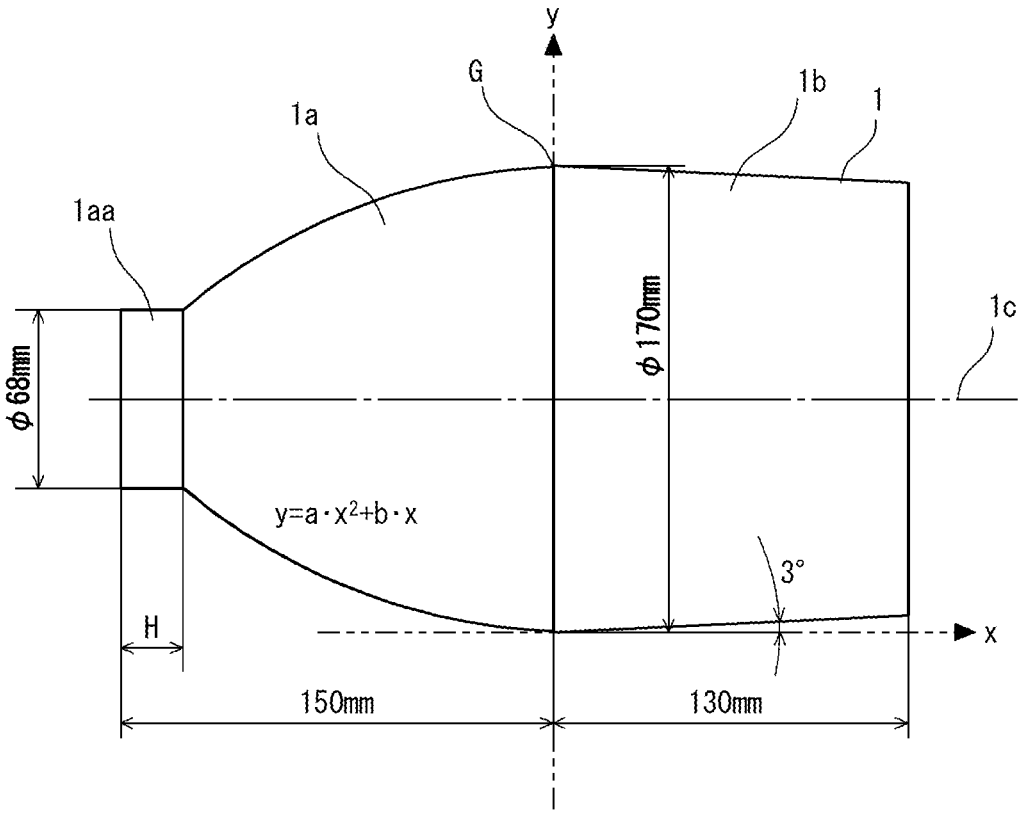
FIG. 15 is an external view of an inclined roll that was used for a piercing-rolling test.

FIG. 15 is an external view of an inclined roll used in the piercing-rolling test. Inclined rolls 1 of Roll Nos. A and B were like the inclined roll shown in FIG. 15.

As shown in FIG. 15, the lateral surface of each of Roll Nos. A or B that were used as the inclined rolls 1 was divided into an entrance-side lateral surface 1*a* and an exit-side lateral surface 1*b* by a gorge G. The entrance-side lateral surface 1*a* was a convex surface. When the entrance-side lateral surface 1*a* was cut along the central axis 1*c* of the inclined roll 1, a convexly curved line was seen. This convexly curved line was expressed by a high-order polynomial function. The exit-side lateral surface 1*b* was a taper surface. The inclined rolls 1 of Roll Nos. A and B were the same in the overall length. The inclined rolls 1 of Roll Nos. A and B were the same in the length in the axial direction of the exit-side lateral surface 1*b*. The inclined rolls 1 of Roll Nos. A and B were different in the length in the axial direction of the entrance-side lateral surface 1*a*, depending on the high-order polynomial function expressing the convexly curved line defining the convex surface. Therefore, an auxiliary cylinder 1*aa* was attached to the entrance-side end of the entrance-side lateral surface 1*a* as needed. The overall length of the inclined rolls 1 of Roll Nos. A and B was the same as the overall length of the above-described inclined rolls 1 of Roll Nos. O to Z and R60 to R600.

Table 8 below shows the dimensions of Roll Nos. A and B used as the inclined rolls 1. FIG. 15 shows the dimensions that were common to Roll Nos. A and B used as the inclined rolls 1. In Table 8, "a" and "b" are the coefficients in the high-order polynomial function expressing the convexly curved line defining the convex surface of the entrance-side lateral surface 1*a*, as shown in FIG. 15. In Table 8, "H" denotes the length of the auxiliary cylinder 1*aa* in the axial direction, as shown in FIG. 15.

TABLE 8

| Roll No. | a | b | H [mm] |
|---|---|---|---|
| A | 0.0020 | 0.0083 | 0.00 |
| B | 0.0021 | 0.0852 | 13.13 |

In the piercing-rolling test of Example 5, piercing rolling was performed under Conditions 46 to 48 in Example 4 by using rolls of Roll Nos. A and B. As in Example 4, it was checked whether any failure occurred or not during piercing rolling under each of Conditions 46 to 48.

Figure 16:
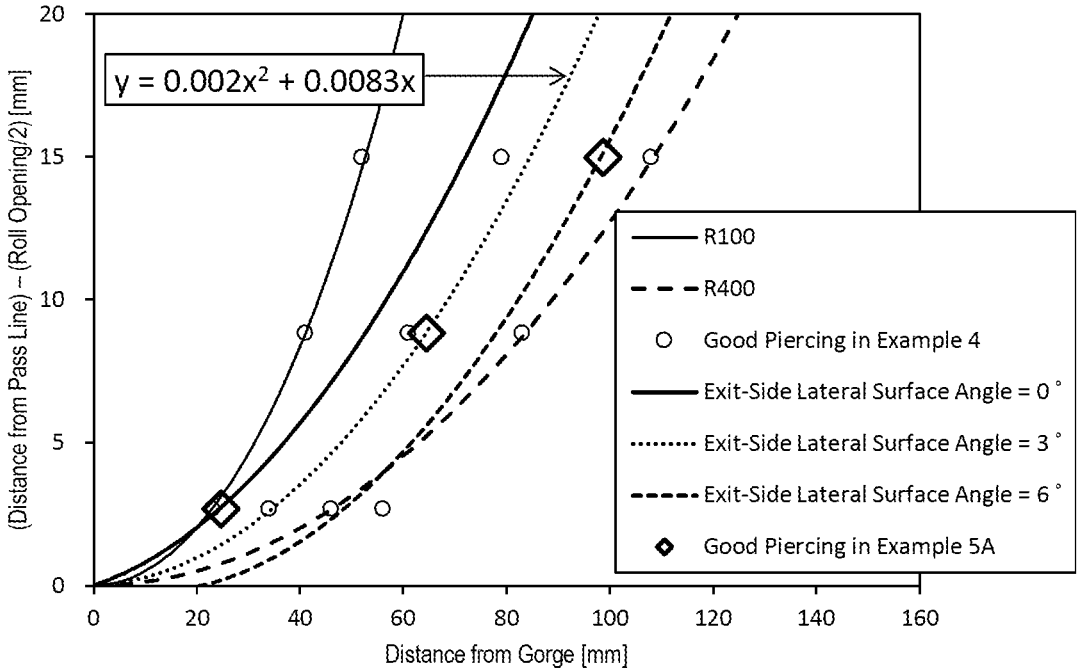
FIG. 16 is a graph showing the occurrence/non-occurrence of failures in EXAMPLE 5.
Figure 17:
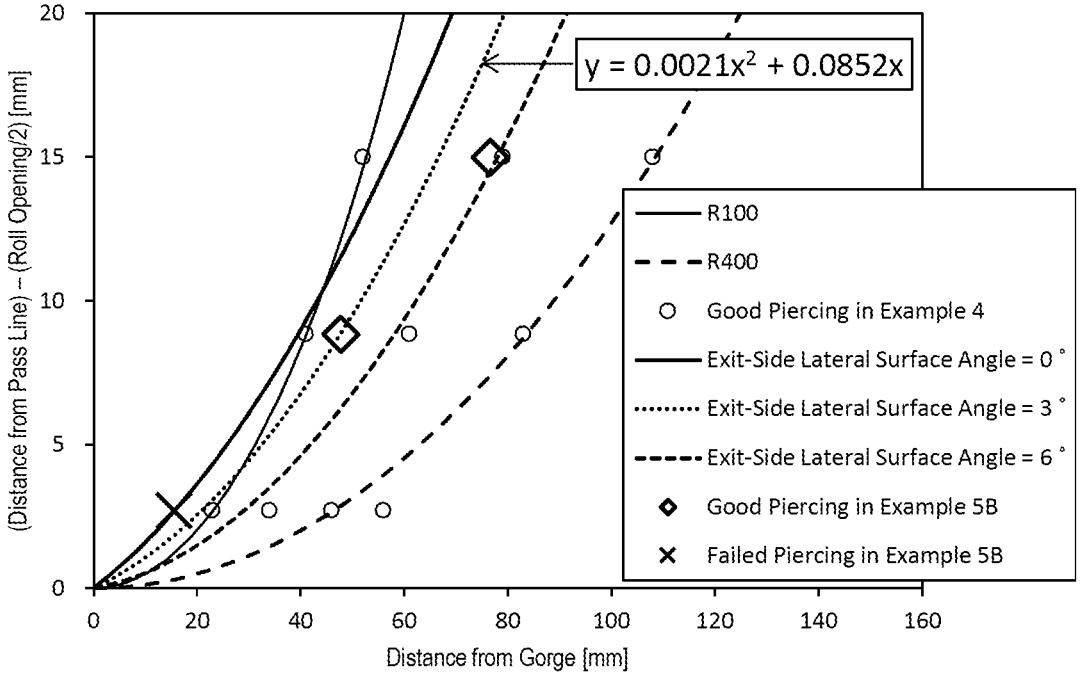
FIG. 17 is a graph showing the occurrence/non-occurrence of failures in EXAMPLE 5.

FIGS. 16 and 17 are graphs showing the occurrence/non-occurrence of failures in Example 5. FIG. 16 shows the results when inclined rolls of Roll No. A were used. FIG. 17 shows the results when inclined rolls of Roll No. B were used. In FIGS. 16 and 17, the horizontal axis indicates distance from gorge [mm], and the vertical axis indicates (distance from pass line)−(roll opening/2) [mm]. In FIGS. 16 and 17, "◇" means that no failure occurred, and "x" means that a failure occurred. FIGS. 16 and 17 additionally show the conditions of piercing rolling and the range for the contact start point that caused no failure in Example 4.

As shown in FIG. 16, in piercing rolling using inclined rolls 1 of Roll No. A, in any case that the exit-side lateral surface angle was 0 degrees, 3 degrees or 6 degrees, the round billet came into contact with the inclined rolls at a point within the range that caused no failure in Example 4, and no failure occurred. As shown in FIG. 17, in piercing rolling using inclined rolls of Roll No. B, when the exit-side lateral surface angle was 0 degrees, the round billet came into contact with the inclined rolls at a point outside the range that caused no failure in Example 4. At that time, an engagement failure occurred.

Example 6

In Example 6, a piercing-rolling test was conducted in the same manner as in Example 1. In the piercing-rolling test of Example 6, two more kinds of inclined rolls (Roll Nos. C and D) were used.

Figure 18:
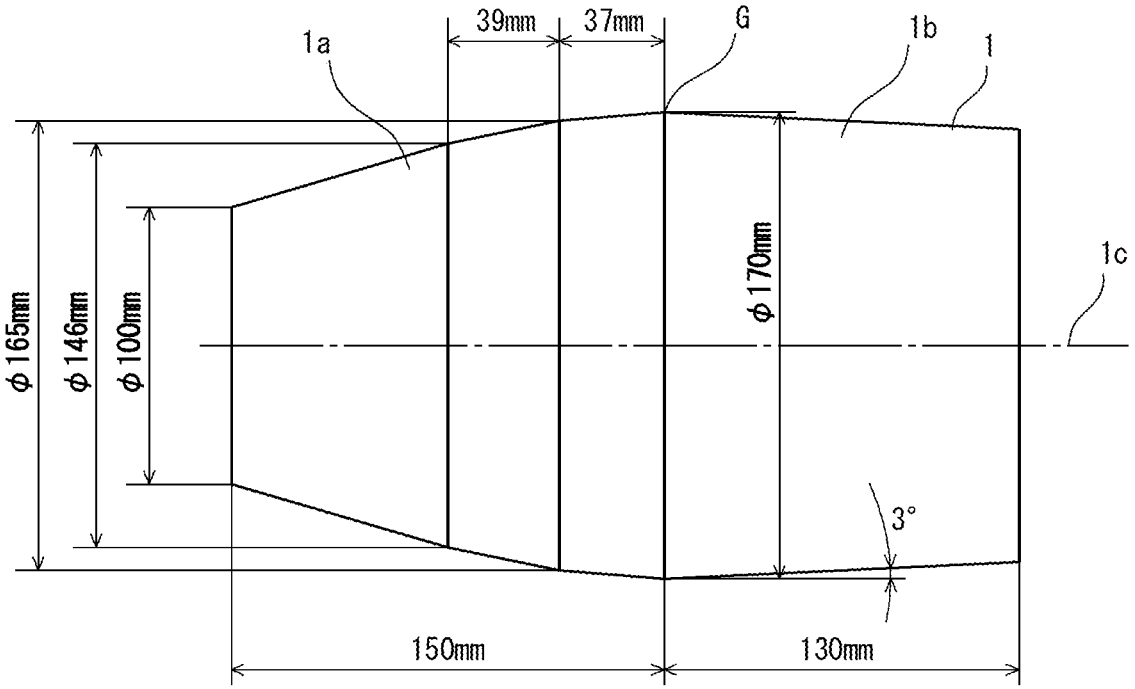
FIG. 18 is an external view of an inclined roll that was used for a piercing-rolling test.
Figure 19:
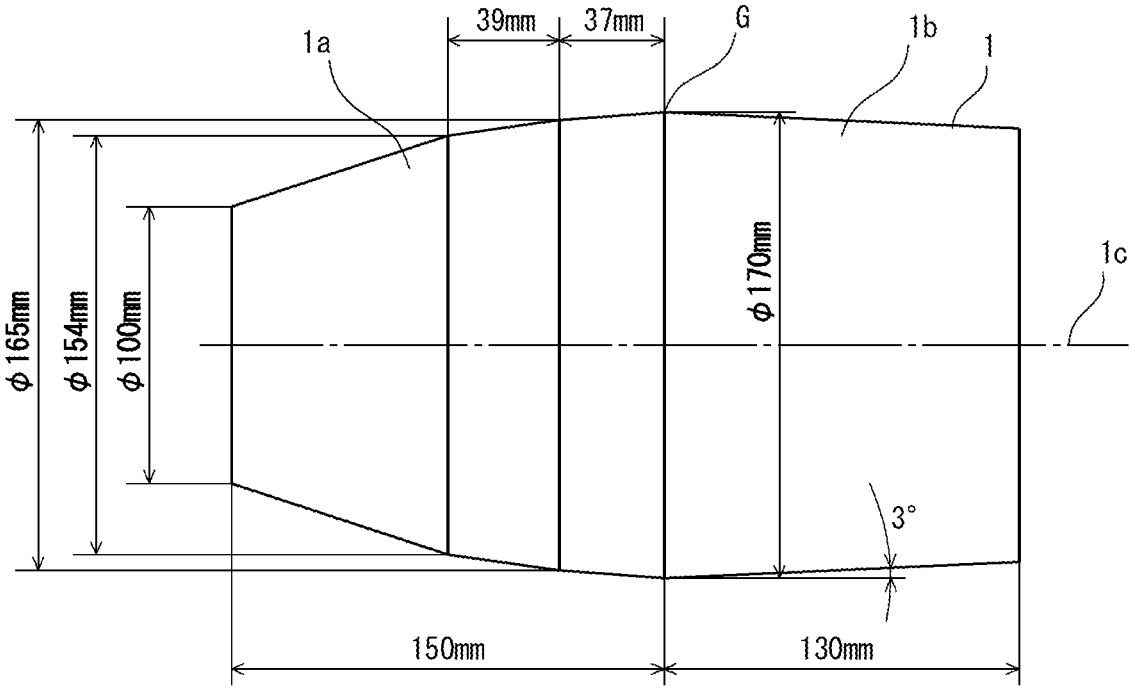
FIG. 19 is an external view of an inclined roll that was used for a piercing-rolling test.

FIGS. 18 and 19 are external views of inclined rolls used in the piercing-rolling test. FIG. 18 shows an inclined roll 1 of Roll No. C. FIG. 19 shows an inclined roll 1 of Roll No. D.

As shown in FIGS. 18 and 19, the lateral surface of each of the inclined rolls 1 of Roll No. C and Roll No. D was divided into an entrance-side lateral surface 1*a* and an exit-side lateral surface 1*b* by a gorge G. The entrance-side lateral surface 1*a* was a three-step taper surface. The entrance-side lateral surface 1*a* is a taper surface (convex surface) with its gradient changing in three steps along the central axis 1*c*. The exit-side lateral surface 1*b* is a taper surface with a constant gradient. The inclined rolls 1 of Roll Nos. C and D were the same in the length of the entrance-side lateral surface 1*a* in the axial direction. The inclined rolls 1 of Roll Nos. C and D were the same in the length of the exit-side lateral surface 1*b* in the axial direction. Accordingly, the inclined rolls 1 of Roll Nos. C and D were the same in the overall length. The overall length of the inclined rolls 1 of Roll Nos. C and D was the same as the overall length of the above-described inclined rolls 1 of Roll Nos. A, B, O to Z and R60 to R600.

As in Example 5, in the piercing-rolling test of Example 6, piercing rolling was performed under Conditions 46 to 48 in Example 4 by using Roll Nos. C and D. As in Example 4, it was checked whether any failure occurred or not during piercing rolling under each of Conditions 46 to 48.

Figure 20:
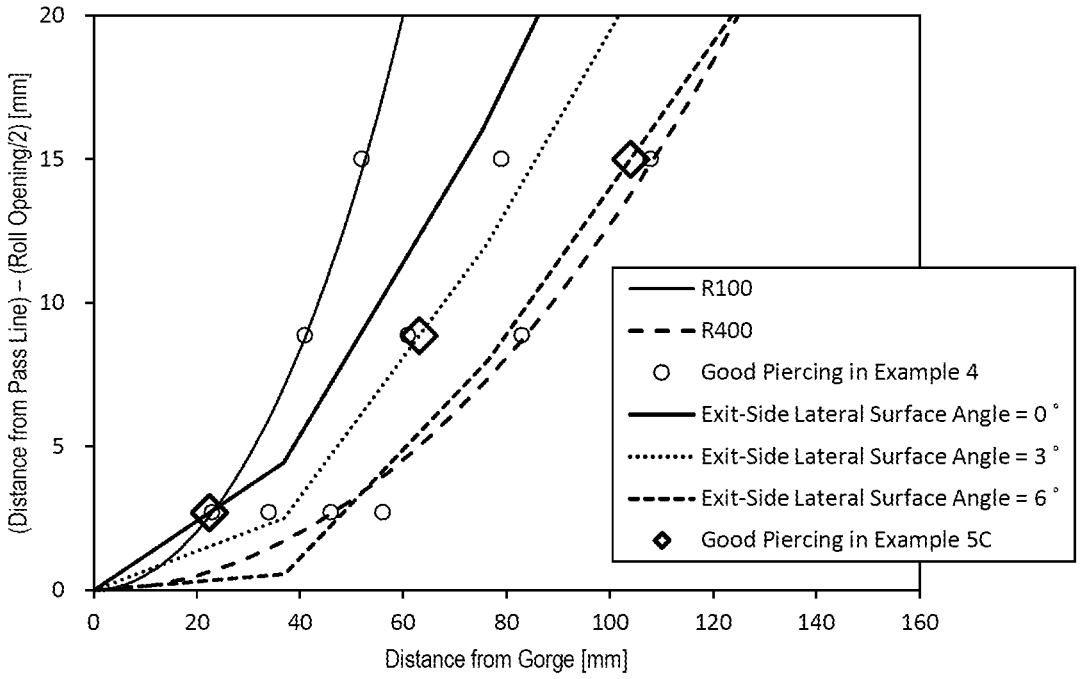
FIG. 20 is a graph showing the occurrence/non-occurrence of failures in EXAMPLE 6.
Figure 21:
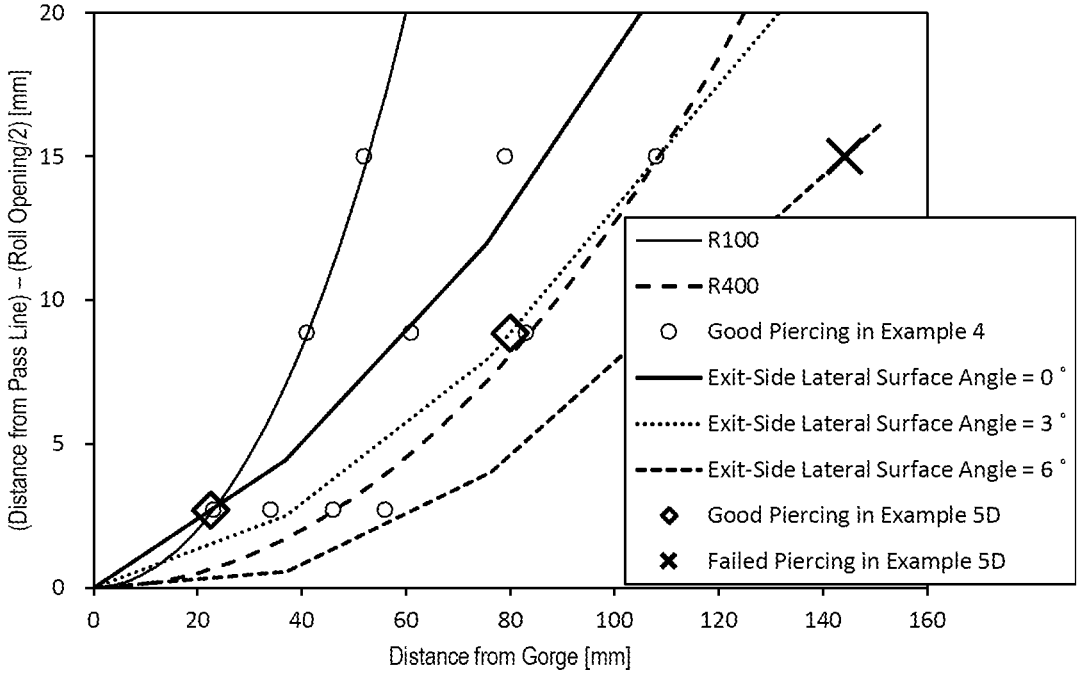
FIG. 21 is a graph showing the occurrence/non-occurrence of failures in EXAMPLE 6.

FIGS. 20 and 21 are graphs showing the occurrence/non-occurrence of failures in Example 6. FIG. 20 shows the results when inclined rolls of Roll No. C were used. FIG. 21 shows the results when inclined rolls of Roll No. D were used. In FIGS. 20 and 21, the horizontal axis indicates distance from gorge [mm], and the vertical axis indicates (distance from pass line)−(roll opening/2) [mm]. In FIGS. 20 and 21, "◇" means that no failure occurred, and "x" means that a failure occurred. FIGS. 20 and 21 additionally show the conditions of piercing rolling and the range for the contact start point that caused no failure in Example 4.

As shown in FIG. 20, in piercing rolling using inclined rolls of Roll No. C, in any case that the exit-side lateral surface angle was 0 degrees, 3 degrees or 6 degrees, the round billet came into contact with the inclined rolls at a point within the range that caused no failure in Example 4, and no failure occurred. As shown in FIG. 21, in piercing rolling using inclined rolls of Roll No. D, when the exit-side lateral surface angle was 6 degrees, the round billet came into contact with the inclined rolls at a point outside the range that caused no failure in Example 4. At that time, the material fluctuated in circumferential length.

Based on the results of Examples 4 to 6, the relationship between engaging angle (α) and gorge draft ratio was sorted out.

Figure 22:
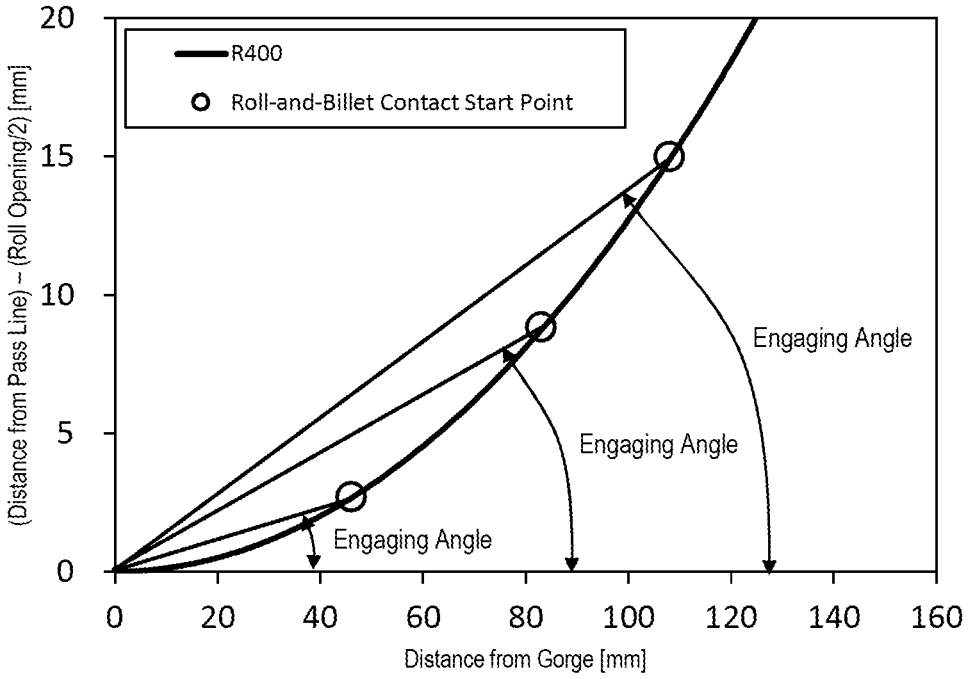
FIG. 22 is a diagram showing an engaging angle ($\alpha$).

FIG. 22 is a diagram for explanation of the engaging angle (α). In FIG. 22, the horizontal axis indicates distance from gorge [mm], and the vertical axis indicates (distance from pass line)−(roll opening/2). In FIG. 22, "○" shows a contact start point. The origin corresponds to the gorge point. The horizontal axis corresponds to the pass line. Straight lines between each of the contact start points and the gorge point are drawn. The angle between each of the lines and the pass line is an engaging angle (α). This is as already described above.

Figure 23:
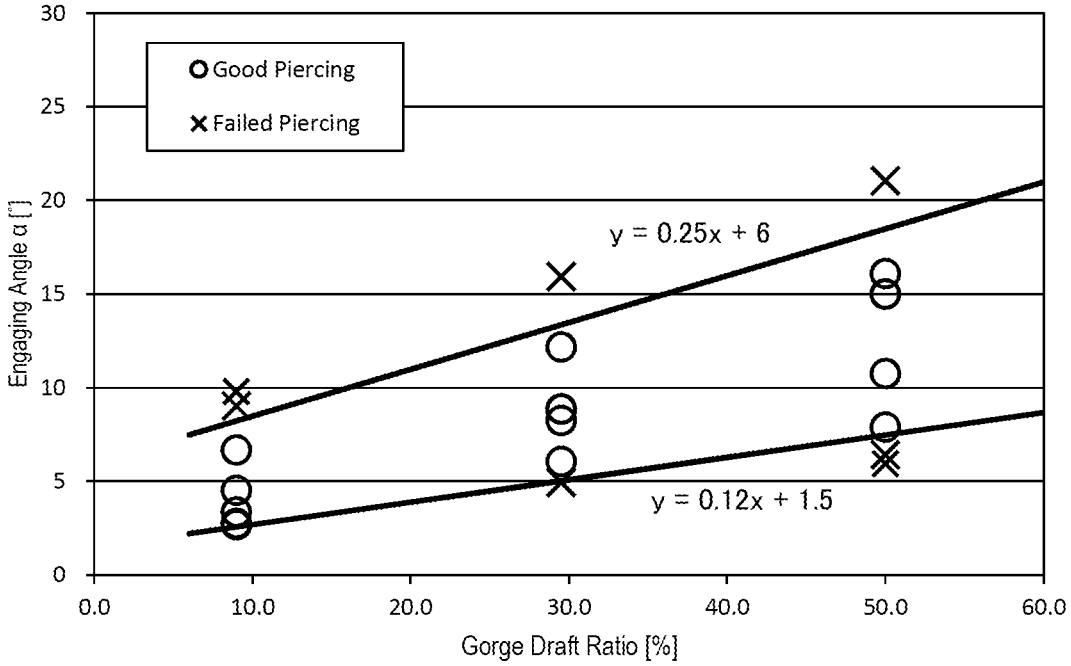
FIG. 23 is a graph showing the occurrence/non-occurrence of failures in relation to engaging angle ($\alpha$) and gorge draft ratio.

FIG. 23 is a graph showing the occurrence/non-occurrence of failures based on the relationship between engaging angel (α) and gorge draft ratio. In FIG. 23, the horizontal axis indicates gorge draft ratio [%], and the vertical axis indicates engaging angle (α) [°]. In FIG. 23, "○" means that no failure occurred, "x" means that a failure occurred.

The following is derived from the results shown in FIG. 23. A larger gorge draft ratio requires a larger engaging angle (α). In order to increase the gorge draft ratio, the roll opening is decreased. When the roll opening is small, the piercing rolling has a high piercing ratio. On the other hand, a smaller gorge draft ratio requires a smaller engaging angle (α). In order to decrease the gorge draft ratio, the roll opening is increased. When the roll opening is large, the piercing rolling has a low piercing ratio.

Therefore, as expressed by Formula (1) above, the engaging angle (α) is preferably equal to or greater than "0.12×GD+1.5" and equal to or smaller than "0.25×GD+6". From another point of view, the entrance-side lateral surface should have a gradient that becomes greater with decreasing distance from the entrance-side end such that the condition expressed by Formula (1) can be satisfied.

Needless to say, the present invention is not limited to the above-described embodiment, and it is possible to make various modifications without departing from the scope of the present invention.

INDUSTRIAL APPLICABILITY

The production method according to the present invention is beneficially applicable to production of a seamless metal tube by Mannesmann process.

LIST OF REFERENCE SIGNS

1: inclined roll
1*a*: entrance-side lateral surface
1*b*: exit-side lateral surface
1*c*: central axis
2: plug
PL: pass line
WP: workpiece
CA: cross angle
FA: feed angle

The invention claimed is:

1. A seamless metal tube production method for producing a first seamless metal tube with a first wall thickness and a second seamless metal tube with a second wall thickness, which is different from the first wall thickness, by using an inclined rolling mill, wherein:

the inclined rolling mill comprises:

a plug located on a pass line; and three inclined rolls arranged equiangularly around the pass line, each of which has an entrance-side lateral surface and an exit-side lateral surface, the distance between the pass line and the entrance-side lateral surface decreasing gradually with increasing distance from an entrance of the inclined rolls and decreasing distance from an exit of the inclined rolls along the pass line, and the distance between the pass line and the exit-side lateral surface increasing gradually with increasing distance from the entrance of the inclined rolls and decreasing distance from the exit of the inclined rolls along the pass line; and the production method comprises:

a first inclination rolling step of rolling a first heated workpiece by the inclined rolling mill;

a setting changing step of changing a setup condition of the inclined rolling mill in the following manner (a) or (b):

(a) when the second wall thickness is smaller than the first wall thickness, positioning the three inclined rolls closer to the pass line than during the first inclination rolling step and making a cross angle of each of the inclined rolls greater than a cross angle of each of the inclined rolls set for the first inclination rolling step; or (b) when the second wall thickness is larger than the first wall thickness, positioning the three inclined rolls farther from the pass line than during the first inclination rolling step and making the cross angle of each of the inclined rolls smaller than the cross angle of each of the inclined rolls set for the first inclination rolling step; and a second inclination rolling step of rolling a second heated workpiece by the inclined rolling mill under the changed condition.

2. The seamless metal tube production method according to claim 1, wherein:

at the first inclination rolling step and at the second inclination rolling step, an angle of the exit-side lateral surface in a contact area where the exit-side lateral surface is in contact with the first workpiece or the second workpiece is defined; and at the first inclination rolling step, when the ratio of the first wall thickness to the outer diameter of the first seamless metal tube is equal to or less than 0.07, the angle of the exit-side lateral surface in the contact area is more than 3 degrees and less than 9 degrees; and at the second inclination rolling step, when the ratio of the second wall thickness to the outer diameter of the second seamless metal tube is equal to or less than 0.07, the angle of the exit-side lateral surface in the contact area is more than 3 degrees and less than 9 degrees.

3. The seamless metal tube production method according to claim 1, wherein:

the entrance-side lateral surface is a convex surface; and the inclined rolls used at the first inclination rolling step are used at the second inclination rolling step.

4. The seamless metal tube production method according to claim 1, wherein:

the first workpiece and the second workpiece are solid; and at the first inclination rolling step and the second inclination rolling step, a piercing ratio of 3.5 or more is aimed at, an angle of the entrance-side lateral surface is equal to or more than 8 degrees and equal to or less than 15 degrees, and a gorge draft ratio is 30% or higher.

5. The seamless metal tube production method according to claim 1, wherein:

the first workpiece and the second workpiece are solid;

the entrance-side lateral surface is a convex surface, and in a section including the central axis of the inclined roll, a circular arc is seen as a line defining the entrance-side lateral surface; and a value calculated by dividing the radius of curvature of the circular arc by the outer diameter of the first workpiece and a value calculated by the radius of curvature of the circular arc by the outer diameter of the second workpiece are equal to or more than 1.67 and equal to or less than 6.67.

6. The seamless metal tube production method according to claim 1, wherein:

the first workpiece and the second workpiece are solid; and at the first inclination rolling step and the second inclination rolling step, the gorge draft ratio (GD) and an engaging angle ($\alpha$) satisfy the condition expressed by the following formula (1)

$$0.12\times GD+1.5\leq\alpha\leq 0.25\times GD+6 \quad (1).$$

* * * * *